US012716156B2

(12) United States Patent
Chung et al.

(10) Patent No.: US 12,716,156 B2
(45) Date of Patent: Aug. 25, 2026

(54) WASHING MACHINE DRY CYCLE RECOMMENDATIONS

(71) Applicant: Haier US Appliance Solutions, Inc., Wilmington, DE (US)

(72) Inventors: MyungGeon Chung, Seoul (KR); Keenan Gizzi, Black Mountain, NC (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 456 days.

(21) Appl. No.: 18/457,792

(22) Filed: Aug. 29, 2023

(65) Prior Publication Data

US 2025/0075391 A1 Mar. 6, 2025

(51) Int. Cl.
*D06F 33/70* (2020.01)
*D06F 37/22* (2006.01)
(Continued)

(52) U.S. Cl.
CPC ..... *D06F 33/70* (2020.02); *D06F 37/225* (2013.01); *D06F 39/14* (2013.01); *D06F 2103/04* (2020.02); *D06F 2105/58* (2020.02)

(58) Field of Classification Search
CPC ..... D06F 33/70; D06F 37/225; D06F 39/14; D06F 2103/04; D06F 2105/58;
(Continued)

(56) References Cited

U.S. PATENT DOCUMENTS

2010/0205823 A1* 8/2010 Ashrafzadeh ..... D06F 33/00 34/445
2015/0292134 A1 10/2015 Dale et al.
(Continued)

FOREIGN PATENT DOCUMENTS

CN 114075748 A 2/2022
CN 114134690 A 3/2022
(Continued)

OTHER PUBLICATIONS

Cook, James et al., "Using Machine Learning to Predict Parking Difficulty", Google Research Blog, https://blog.research.google/2017/02/using-machine-learning-to-predict.html, published Feb. 3, 2017, 6 pages.
(Continued)

*Primary Examiner* — John P Mccormack
(74) *Attorney, Agent, or Firm* — Dority & Manning, P.A.

(57) ABSTRACT

A method of treating a load of articles in a wash basket of a washing machine appliance includes determining a load size of the load of articles in the wash basket based on an image. The method further includes estimating a drying time for drying the load of articles in a one-step wash and dry cycle and predicting a demand for the washing machine appliance during the drying time. The one-step wash and dry cycle is recommended based on the determined load size less than a load size maximum and the predicted demand for the washing machine appliance during the drying time less than a maximum demand. The method further includes drying the load of articles in the wash basket during a dry portion of the one-step wash and dry cycle by rotating the wash basket within the washing machine appliance for the drying time.

18 Claims, 14 Drawing Sheets

(51) Int. Cl.
*D06F 39/14* (2006.01)
*D06F 103/04* (2020.01)
*D06F 105/58* (2020.01)

(58) Field of Classification Search
CPC ..... D06F 2103/00; D06F 2103/38; D06F 2105/32; D06F 33/64; D06F 2101/00; D06F 2105/30; D06F 34/18
USPC ..... 34/524
See application file for complete search history.

(56) References Cited

U.S. PATENT DOCUMENTS

| | | | | |
|---|---|---|---|---|
| 2021/0079579 | A1* | 3/2021 | Bover Capdevila .... | D06F 34/28 |
| 2021/0108351 | A1* | 4/2021 | Patterson ..... | D06F 33/30 |
| 2022/0349102 | A1* | 11/2022 | Yun ..... | G06N 3/092 |

FOREIGN PATENT DOCUMENTS

| | | | |
|---|---|---|---|
| JP | 2022084468 | A | 6/2022 |
| KR | 20180049718 | A | 5/2018 |

OTHER PUBLICATIONS

Girshick, Ross et al., "Rich feature hierarchies for accurate object detection and semantic segmentation", Cornell University, https://arxiv.org/abs/1311.2524, Submitted Nov. 11, 2013, last revised Oct. 22, 2014, 21 pages.

"Front Load Washers—1-Step Wash & Dry Cycle", GE Appliances, https://products.geappliances.com/appliance/gea-support-search-content?contentId=39771, accessed Aug. 29, 2023, 3 pages.

* cited by examiner

WASHING MACHINE DRY CYCLE RECOMMENDATIONS

FIELD OF THE INVENTION

The present subject matter relates generally to washing machine appliances, and more particularly to washing machine appliances operable to perform a drying cycle, such as a one-step wash and dry cycle in a single, continuous cycle of a single appliance.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Some existing washing machine appliances, such as horizontal axis washing machines, are provided with one or more ventilation features. Such features may allow a washing machine appliance to exchange air between the wash tub and the ambient environment. The exchange of air may be useful to dry the wash tub, wash basket, and/or articles therein.

Although such ventilation features may be used to dry articles in a washing machine appliance, the drying process may take an excessively long time and/or may not dry the articles to the extent desired. For example, a drying cycle in a washing machine appliance may be recommended only for smaller loads, whereas attempting to run the drying cycle in the washing machine appliance on a larger load may result in underdrying the load, an extended dry time, or other suboptimal drying performance. As another example, when the washing machine appliance is a commercial appliance, e.g., in a laundromat, the extended time for using the ventilation features of the washing machine appliance to dry articles therein, e.g., as compared to drying the articles in a separate dryer appliance, may be undesirable when the laundromat is busy or crowded.

Some laundry appliances are operable to determine a load size for a load of articles based on a user input indicating the load size, which may be received via a user interface of the laundry appliance. Such user interfaces, however, rely on the user to provide accurate information regarding the size of the load of articles. Moreover, such interfaces are not intuitive, e.g., a user may be required to subjectively determine what constitutes a "large" load size or a "medium" load size, where such load sizes may be abstract concepts to the user. When the user provides inaccurate information, such as an incorrect load size or when the user overloads the washing machine appliance, the performance of the laundry appliance may be impaired and/or the results of article treatment operations (such as washing and/or drying operations) may be less than optimal.

As a result, it is desired in the art to provide improved operation of washing machine appliances. For example, such improved operation may be provided based on more accurate and consistent information regarding a load of articles in the washing machine appliance and/or a predicted efficacy for a drying cycle in the washing machine appliance based on the load of articles.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of treating a load of articles in a wash basket of a washing machine appliance is provided. The method includes obtaining an image of the wash basket of the washing machine appliance and the load of articles therein. The method also includes determining a load size of the load of articles in the wash basket is less than a load size maximum based on the image. The method further includes estimating a drying time for drying the load of articles in a one-step wash and dry cycle and predicting a demand for the washing machine appliance during the drying time. The method also includes determining the one-step wash and dry cycle is recommended based on the determined load size less than the load size maximum and the predicted demand for the washing machine appliance during the drying time less than a maximum demand. The method further includes receiving a start input for the one-step wash and dry cycle and performing the one-step wash and dry cycle in the washing machine appliance in response to the start input. The one-step wash and dry cycle includes successively washing and drying the load of articles in the wash basket of the washing machine appliance. Drying the load of articles in the washing machine appliance during the one-step wash and dry cycle includes rotating the wash basket within the washing machine appliance for the drying time.

In another exemplary aspect of the present disclosure, a method of treating a load of articles in a wash basket of a washing machine appliance is provided. The method includes obtaining an image of the wash basket of the washing machine appliance and the load of articles therein. The method also includes determining a load size of the load of articles in the wash basket is less than a load size maximum based on the image. The method further includes estimating a drying time for drying the load of articles in a one-step wash and dry cycle and predicting a demand for the washing machine appliance during the drying time. The method also includes determining the one-step wash and dry cycle is recommended based on the determined load size less than the load size maximum and the predicted demand for the washing machine appliance during the drying time less than a maximum demand and drying the load of articles in the wash basket during a dry portion of the one-step wash and dry cycle by rotating the wash basket within the washing machine appliance for the drying time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
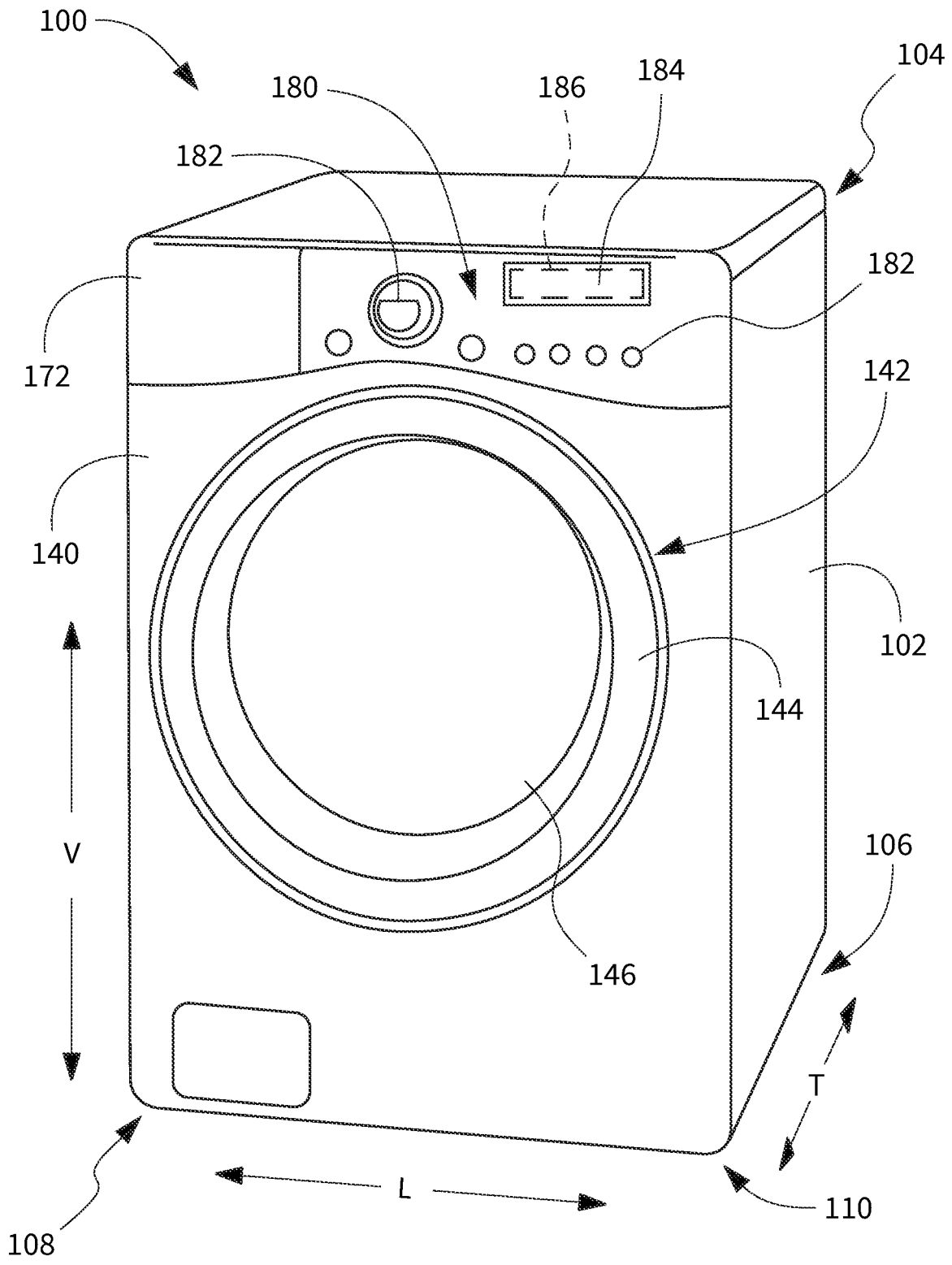
FIG. 1 provides a perspective view of a washing machine appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Figure 2:
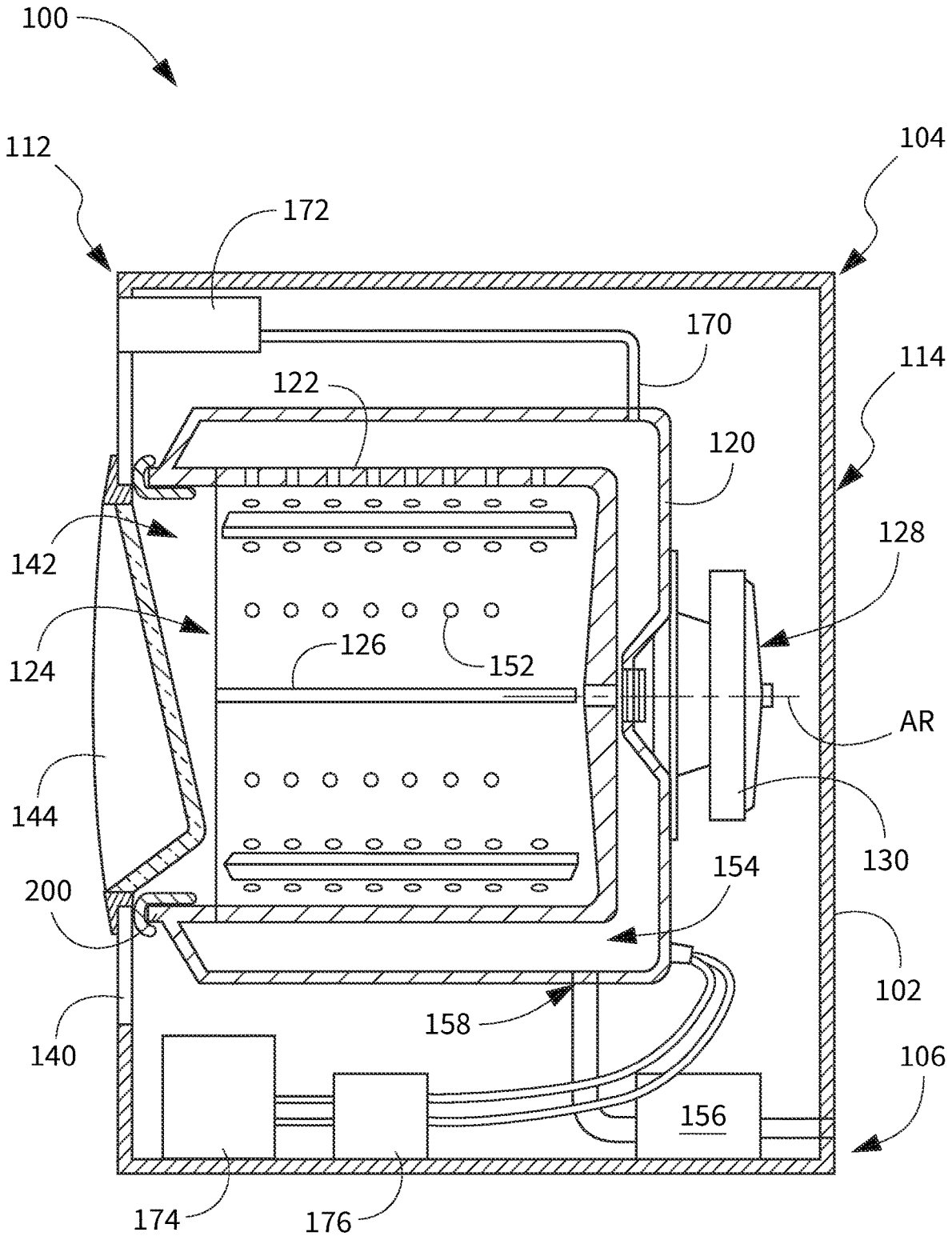
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. For example, when the door 144 is in the closed position, the wash tub 120 may be generally enclosed (e.g., at least 90% enclosed and at least 90% surrounded on all sides, such as fully enclosed with the exception of a vent line 190 and/or vent aperture 202 as will be described below) by the door 144 and the cabinet 102. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a perimeter, e.g., circumference, of the opening 142 and may extend between the cabinet 102 and the wash tub 120 along a longitudinal axis, such as along or generally parallel to the transverse direction T.

It should be appreciated that the present subject matter is not limited to any particular style, model, or configuration of washing machine appliance. The exemplary embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines, and other differences may be applied as well.

Figure 3:
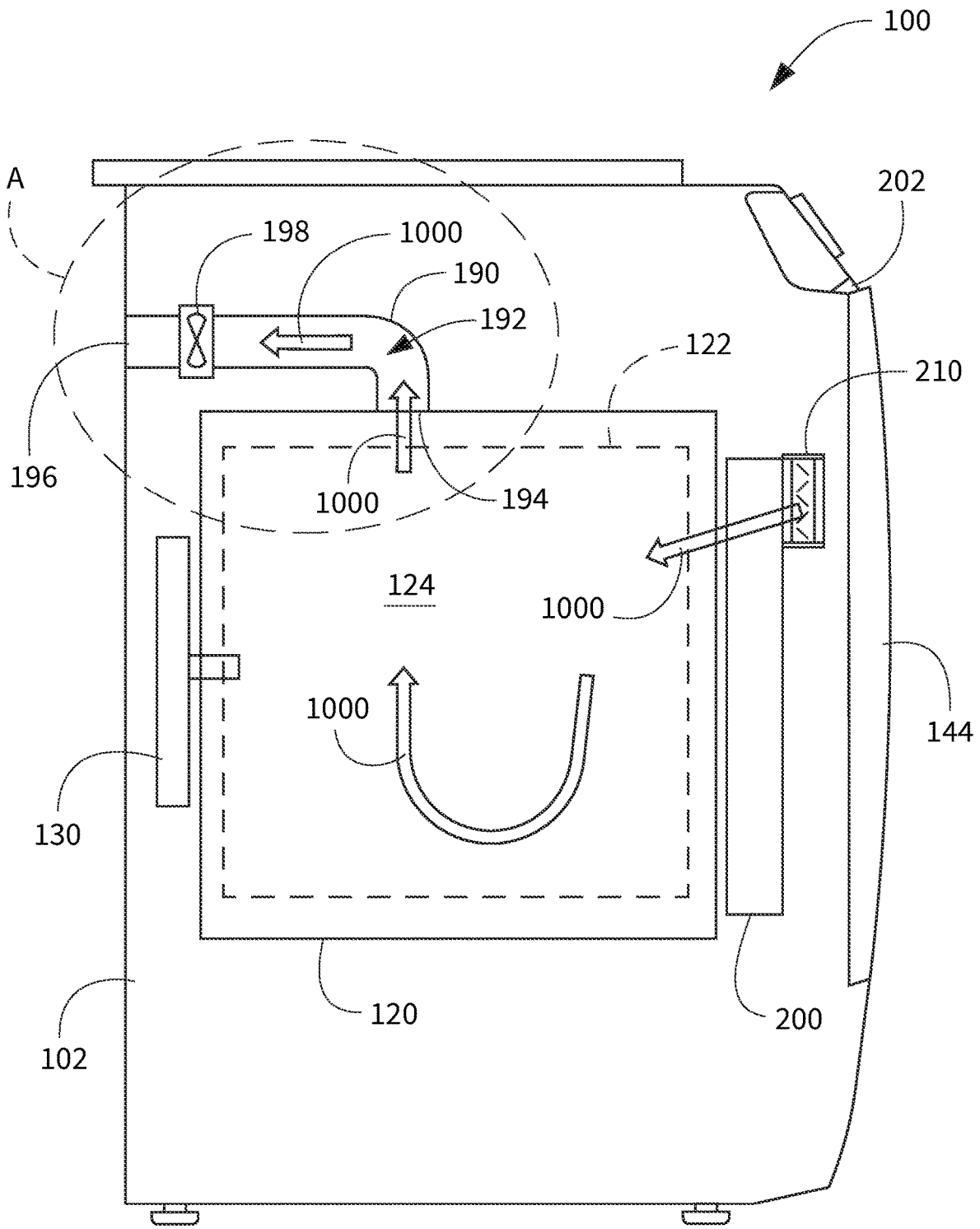
FIG. 3 provides a schematic side view of an exemplary washing machine appliance according to one or more exemplary embodiments of the present disclosure.

As illustrated in FIG. 3, in some embodiments, a ventilation line 190 is provided within washing machine appliance 100. In particular, ventilation line 190 may be enclosed within cabinet 102. As shown in FIG. 3, exemplary embodiments include ventilation line 190 at a position in fluid communication between tub 120 and the surrounding region (e.g., the ambient environment outside of or immediately surrounding cabinet 102, the enclosed volume of cabinet 102 surrounding tub 120, etc.). Generally, it is understood that ventilation line 190 may be provided as any suitable pipe or conduit (e.g., having non-permeable wall) for directing air therethrough. When assembled, ventilation line 190 defines an air path 192 from tub 120 and within or through cabinet 102 (e.g., to the ambient environment outside of cabinet 102). Specifically, air path 192 extends from a ventilation inlet 194, through cabinet 102, and to a ventilation outlet 196. In some embodiments, ventilation inlet 194 is defined through a top portion of wash tub 120 and ventilation outlet 196 is defined through an upper portion of cabinet 102. Thus, air path 192 may extend from the top portion of tub 120 to an upper portion of cabinet 102. Optionally, ventilation inlet 194 may be positioned below ventilation outlet 196 along a vertical direction V. Advantageously, a convective airflow may be naturally motivated from wash tub 120, through air path 192, and to the ambient environment. Also, such airflow may be aided or urged through the washing machine appliance 100 by rotating the wash basket 122. Additionally or alternatively, splashing of wash fluid and the collection of moisture within air path 192 may be prevented. However, any other suitable configuration may be provided to facilitate the flow of air from tub 120 and, for example, to the ambient environment.

Although a convective airflow may be facilitated, optional embodiments further include a fan or blower 198. Specifically, fan 198 may be provided in fluid communication with ventilation line 190 to motivate an active airflow therethrough. For instance, fan 198 may be mounted within ventilation line 190 to selectively rotate and draw air from wash tub 120, through ventilation inlet 194, and to ventilation outlet 196 (e.g., to output an airflow from tub 120 to the ambient environment).

A cabinet aperture 202 may be defined through front panel 140 as an inlet for ambient air to flow from outside of the cabinet 102 to the inside of the cabinet 102, e.g., to and through the tub 120. Notably, in the disclosed embodiments, air 1000 (e.g., an ambient airflow) may flow between tub 120 and the ambient environment through cabinet aperture 202 and/or vent line 190 even while door 144 remains closed.

A vent damper 210 may be provided to selectively control an airflow between tub 120 and, for example, the ambient environment. Generally, vent damper 210 is in communication with wash tub 120 and/or ventilation line 190 (i.e., in fluid communication with air path 192). In certain embodiments, vent damper 210 is enclosed, at least in part, within cabinet 102. Vent damper 210 may be selectively controlled or operated to limit or obstruct the flow of air from the ambient environment into the interior of the cabinet 102, such as to the wash tub 120, via the aperture 202 during certain operations, phases, or cycles. Thus, vent damper 210 may selectively limit airflow between tub 120 and the ambient environment, such as airflow from the ambient environment via the aperture 202.

The damper 210 may be positioned downstream of the aperture 202, e.g., between the aperture 202 and the wash tub 120 and/or between the aperture 202 and the gasket 200. Thus, opening the damper 210 may permit fluid communication, e.g., air flow, between internal components of the washing machine appliance 100, e.g., the wash tub 120 and/or the wash basket 122, and the ambient environment external to the cabinet 102. Thus, the damper 210 may be upstream of the internal components, e.g., wash basket 122, with respect to a flow of ambient air 1000 from the ambient environment external to the cabinet 102 through the washing machine appliance 100. As may be seen in FIG. 3, the flow of ambient air 1000 from the ambient environment external to the cabinet 102 through the washing machine appliance 100 may enter the washing machine appliance 100 through the aperture 202, flow through the damper 210, into and through the wash tub 120, e.g., wash basket 122 and wash chamber 124 therein, and may exit the washing machine appliance 100 via the vent line 190, e.g., by flowing into the vent line 190 at the ventilation inlet 194 from the wash tub 120, flowing through the vent line 190, and returning to the ambient environment from the vent line 190 via the ventilation outlet 196. In some embodiments, such air flow may be aided or urged by fan 198. In additional embodiments, the air flow through the washing machine appliance 100, as illustrated by arrows 1000, may be provided by convective flow and/or rotation of the wash basket 122 without the use or presence of a fan. Such rotation of the wash basket 122, including the ribs 126 therein, may push the air 1000 around to promote circulation of the ambient air 1000 through the washing machine appliance 100, e.g., into and through the wash basket 122. In some embodiments, the fan 198 may not be included, and the flow of ambient air 1000 through the washing machine appliance 100 may be provided solely by natural convection and/or rotation of the wash basket 122.

Figure 4:
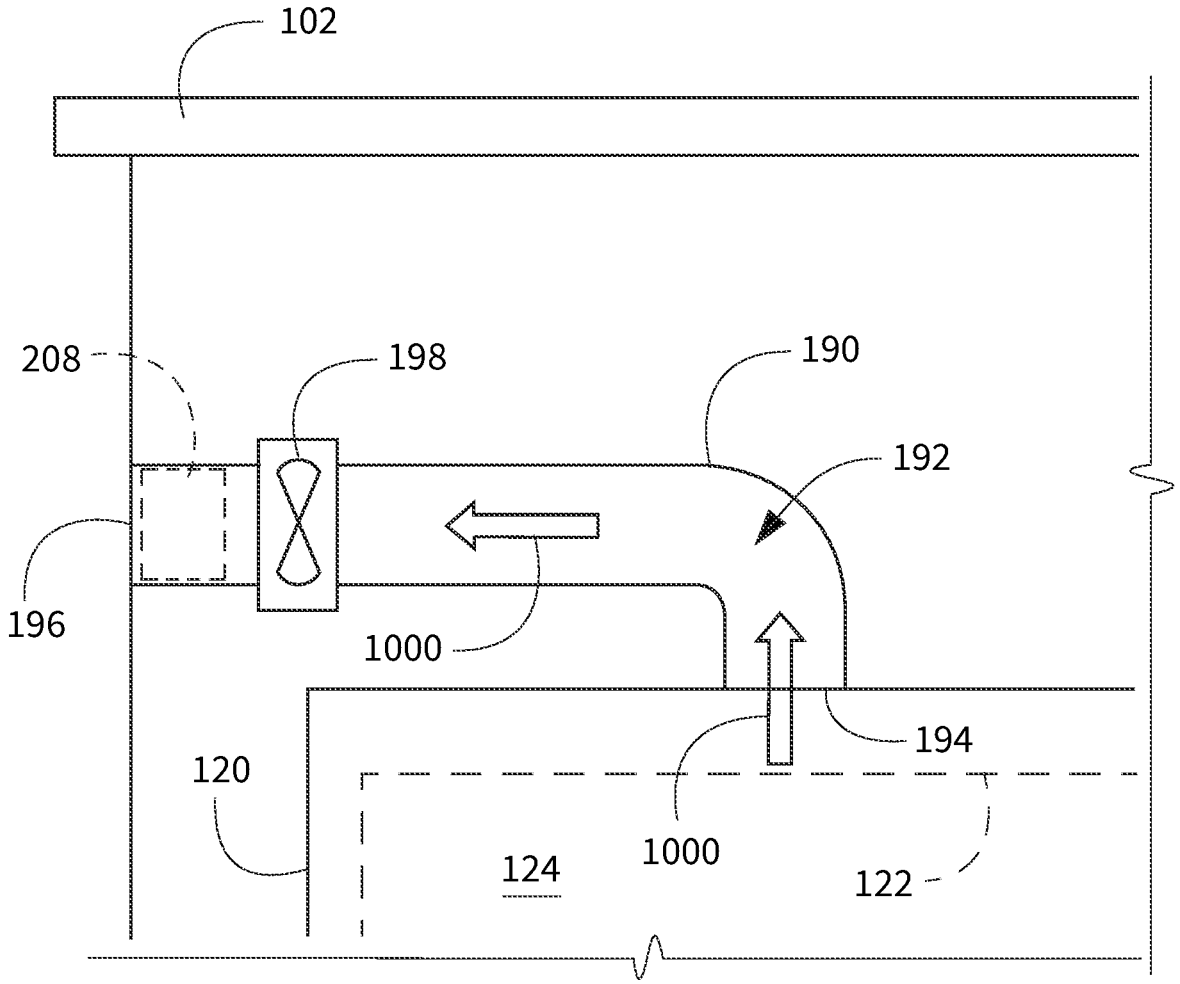
FIG. 4 provides an enlarged view of a portion of the washing machine appliance of FIG. 3 according to one or more exemplary embodiments of the present disclosure.
Figure 5:
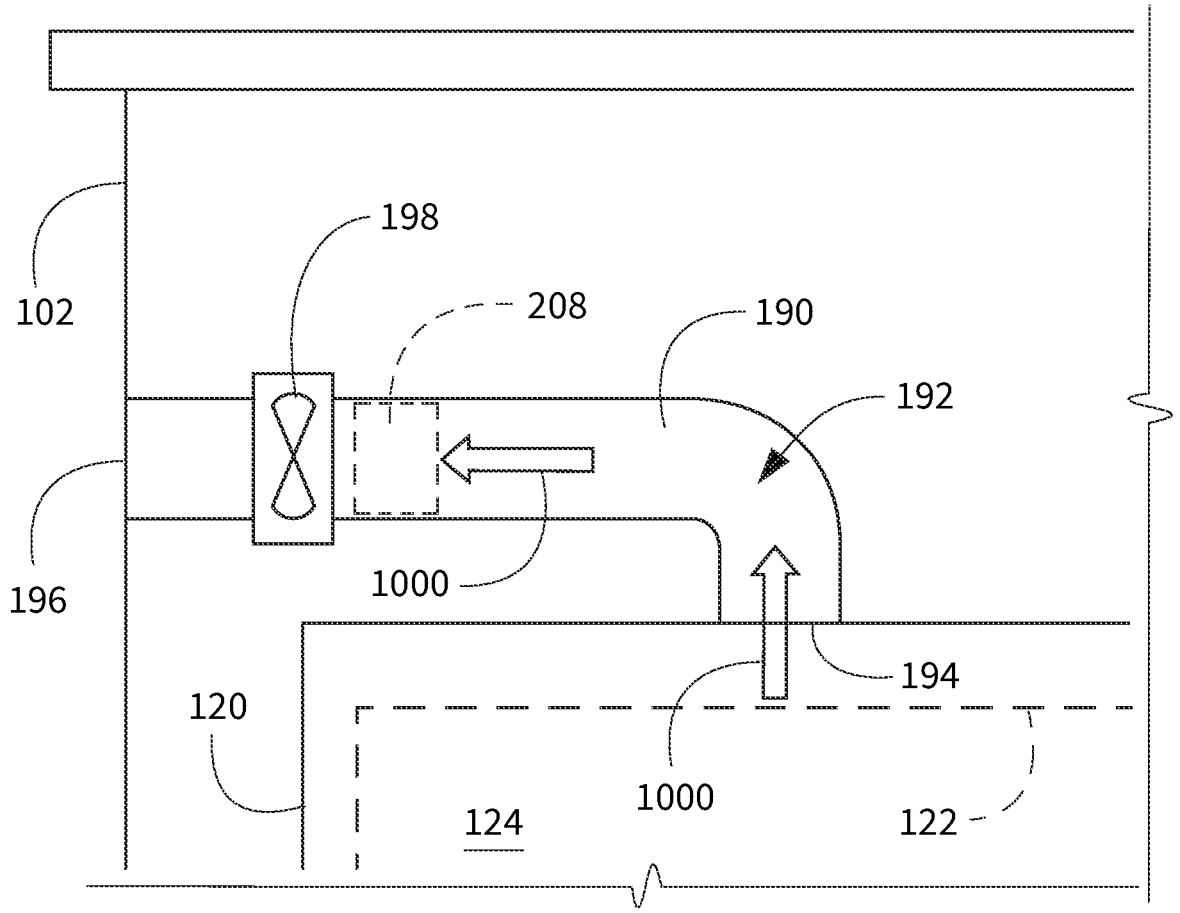
FIG. 5 provides an enlarged view of a portion of the washing machine appliance of FIG. 3 according to one or more additional exemplary embodiments of the present disclosure.
Figure 6:
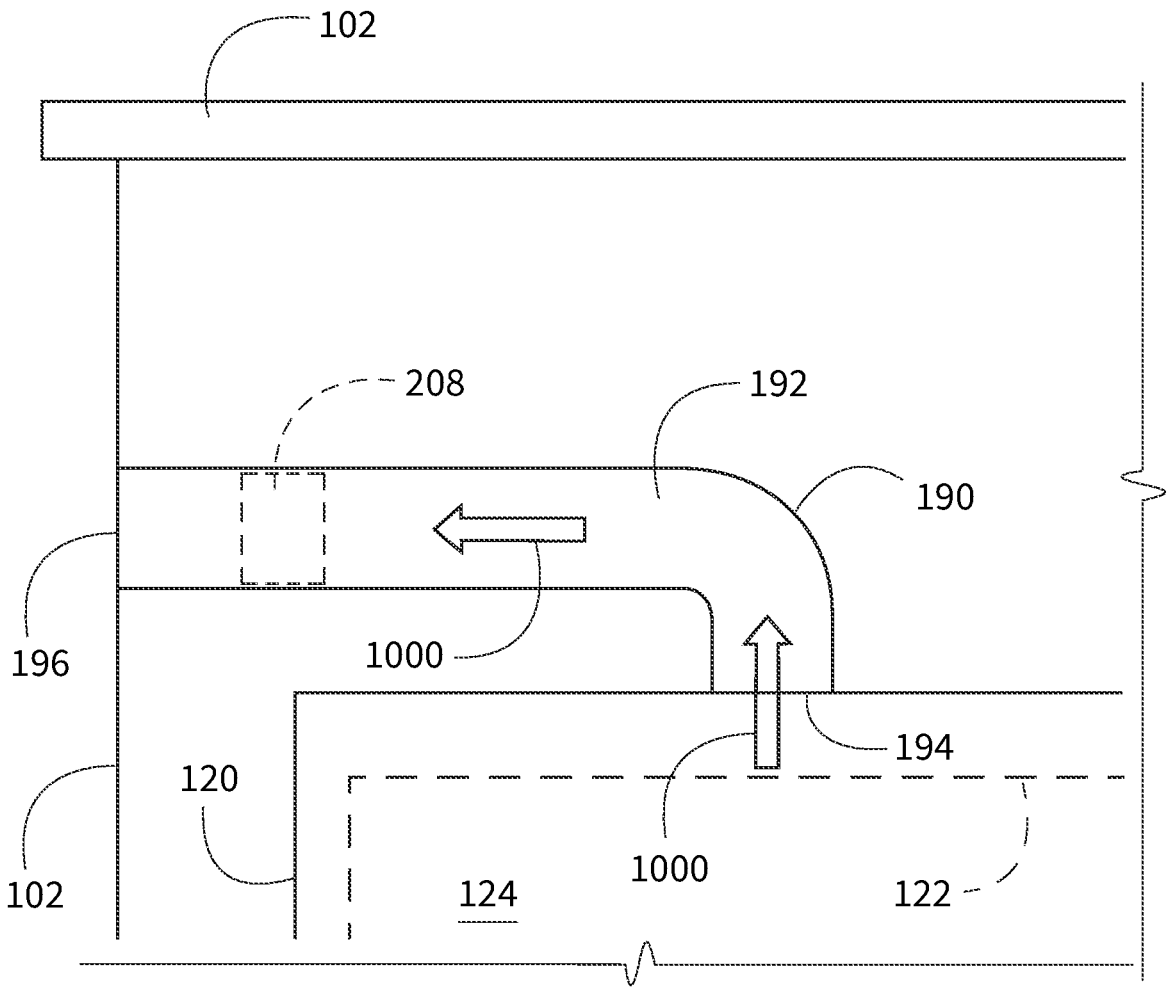
FIG. 6 provides an enlarged view of a portion of the washing machine appliance of FIG. 3 according to one or more further exemplary embodiments of the present disclosure.

FIGS. 4-6 illustrate enlarged views of a portion of the washing machine appliance 100 of FIG. 3, the portion is generally indicated by the oval A in FIG. 3. As illustrated in FIGS. 4-6, the washing machine appliance 100 may also include a humidity sensor 208. In some embodiments, the humidity sensor 208 may be a single humidity sensor 208, e.g., may be the only humidity sensor provided in the washing machine appliance 100, and may be operable to measure both an internal humidity level, e.g., a humidity within the washing machine appliance 100 (such as within the cabinet 102 thereof, such as within the wash tub 120 and/or wash basket 122) and an external humidity level, e.g., a humidity outside of the cabinet 102, such as a humidity of an ambient environment external to the cabinet 102. Humidity sensor 208 may be positioned in any suitable location within washing machine appliance 100. Humidity sensor 208 may be any suitable sensor capable of sensing or measuring the humidity or relative humidity in the air. For instance, humidity sensor 208 may be a capacitive, resistive, or thermal sensor.

As mentioned above, the controller 186 may be in operative communication with various other components of the washing machine appliance 100. In particular, controller 186 is in operative communication with humidity sensor 208, fan 198 (when the fan 198 is provided), damper 210, and motor 130. Accordingly, controller 186 may receive signals from and route signals to these various components. For instance, controller 186 may receive signals from humidity sensor 208 that are indicative of the humidity or relative humidity of the air measured by the humidity sensor 208. Such signals may be used to make decisions as to whether to activate motor 130 to rotate wash basket 122, e.g., to facilitate air flow through the wash tub 120. Controller 186 can receive the signals directly or indirectly from sensor 208. Moreover, controller 186 may send signals to motor 130, e.g., to rotate basket 122, to fan 198, e.g., to blow air within and/or through vent line 190, or controller 186 may send signals to damper 210 to open or close.

In some embodiments, e.g., as illustrated in FIG. 4, humidity sensor 208 may be positioned proximate the ambient environment, such as proximate the ventilation outlet 196. For example, in embodiments which include the fan 198, the humidity sensor 208 may be proximate the ambient environment in that the humidity sensor 208 is downstream of the fan 198, e.g., is between the fan 198 and the ventilation outlet 196. As another example, the humidity sensor 208 may be proximate the ambient environment in that the humidity sensor 208 is closer to the ventilation outlet 196 than to the ventilation inlet 194, such as, where a length of the ventilation line 190 is defined from the ventilation inlet 194 to the ventilation outlet 196, the humidity sensor 208 may be positioned at the ventilation outlet 196 or separated from the ventilation outlet 196 by a distance which is ten percent or less of the length of the ventilation line 190. In such embodiments, the humidity sensor 208 may be operable to measure ambient humidity whenever the washing machine appliance 100 is idle, e.g., when the washing machine appliance 100 is not performing a cycle such as a wash cycle. In particular, it may be advantageous to measure the ambient humidity when the washing machine appliance 100 is idle prior to the first wash cycle of the day, and such ambient humidity measurement may be stored or recorded, e.g., in a memory of the controller 186.

In some embodiments, e.g., as illustrated in FIGS. 5 and 6, humidity sensor 208 may be positioned inside the vent line 190 and away from the ambient environment. For example, in embodiments such as FIG. 5 which include the fan 198, the humidity sensor 208 may be away from the ambient environment in that the humidity sensor 208 is upstream of the fan 198, e.g., where the fan 198 is between the humidity sensor 208 and the ventilation outlet 196, such that the humidity sensor 208 is separated from the ambient environment by the fan 198. As another example, the humidity sensor 208 may be away from the ambient environment in that the humidity sensor 208 separated from the ventilation outlet 196 by a distance which is more than ten percent of the length of the ventilation line 190. In such embodiments, the humidity sensor 208 may be operable to measure ambient humidity whenever the washing machine appliance 100 is idle, assuming that the ambient humidity and the humidity inside the washing machine appliance are approximately the same given sufficient time to equilibrate after a most recent wash cycle. In particular, it may be advantageous to measure the ambient humidity when the washing machine appliance 100 is idle prior to the first wash cycle of the day in order to ensure sufficient time for the humidity to equilibrate, and such ambient humidity measurement may be stored or recorded, e.g., in a memory of the controller 186.

Additionally, in at least some embodiments, in particular those embodiments where the humidity sensor 208 is positioned away from the outlet 196, the humidity sensor 208 may be operable to measure the ambient humidity when ambient air is drawn into the vent line 190, e.g., in the reverse direction of the normal air flow path through the washing machine appliance 100. For example, in embodiments which include the fan 198, the fan 198 may be operable in two directions, e.g., may be a reversible fan, whereby the fan 198 may be operable to spin in a reverse direction in order to draw ambient air into the vent line 190 via the ventilation outlet 196, whereby the humidity sensor 208 may measure an ambient humidity when the fan 198 is operating in the reverse direction. In additional embodiments, such as but not limited to embodiments where there is no fan in the vent line 190, e.g., as illustrated in FIG. 6, the washing machine appliance 100 may be operable to draw ambient air in through the ventilation outlet 196 (which, as noted above, is opposite the normal flow direction of the flow of air through the washing machine appliance 100) when the door 144 is closed, by closing the damper 210 and activating the pump assembly 156, e.g., activating a drain pump. With the door 144 and the damper 210 both closed, the vent line 190 is the only point of ingress or egress for air to or from the interior of the washing machine appliance 100. Thus, activating the pump creates a negative pressure within the wash tub 120, thereby drawing ambient air in through the vent line 190, e.g., past the humidity sensor 208 whereby the humidity sensor 208 may measure an ambient humidity when the door 144 and the damper 210 are both closed and the pump 156 is activated.

In some embodiments, the washing machine appliance 100 may include a second humidity sensor. In such embodiments, the second humidity sensor may be positioned proximate to the damper 210, such as immediately upstream or immediately downstream of the damper 210, e.g., between the damper 210 and the gasket 200 or between the damper 210 and the aperture 202. In such embodiments, the first humidity sensor 208 may be used to measure the humidity within the washing machine appliance 100, and the second humidity sensor may be used to measure the ambient humidity.

As mentioned above, the flow of ambient air 1000 (e.g., FIG. 3) through the washing machine appliance 100 may be facilitated by rotating the wash basket 122. In some embodiments, such rotation may include, e.g., during a drying cycle or drying operation, example embodiments of which will be described below, rotating the basket 122 for an ON period, such as a drying time which may be determined based on the load size and/or load type of articles in the wash basket. In various embodiments, the rotational speed during the ON period may be any suitable speed, such as between about 50 RPM and about 200 RPM, such as about 150 RPM or about 100 RPM. The rotational speed during the ON period may be generally constant, e.g., apart from an inherent acceleration time to reach the set speed.

Figure 7:
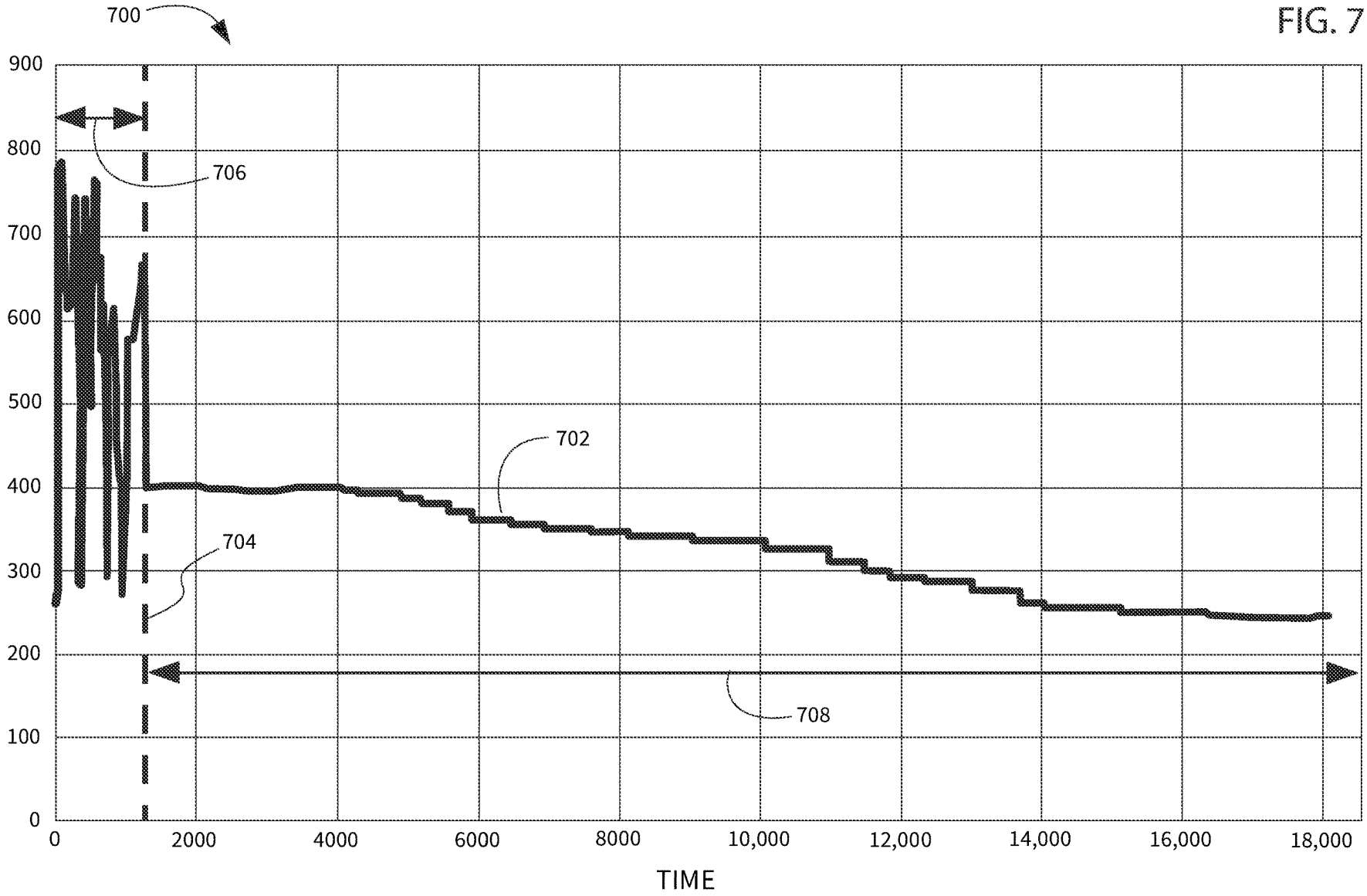
FIG. 7 provides an exemplary plot of humidity over time for an exemplary operation which includes washing and drying a load of articles in a washing machine appliance according to one or more additional exemplary embodiments of the present disclosure.

FIG. 7 illustrates a graph 700 of humidity over time throughout a one-step wash and dry cycle in a washing machine appliance. The one-step one wash and dry cycle is provided merely as an example, embodiments of the present disclosure may also include a different time durations and different humidity levels. As may be seen in FIG. 7, the cycle includes a wash portion 706 and a dry portion 708, which are demarcated by line 704 for illustration purposes in FIG. 7. As shown by line 702, the humidity varies throughout the wash portion 706, and then declines slowly but steadily throughout the dry portion 708 of the cycle. Thus, the exemplary cycle illustrated by the graph 700 in FIG. 7 may be a cycle in which the dry operation performance is sufficient. It should be noted that the humidity values in FIG. 7 are given as percentage values with three significant figures, e.g., the humidity value of "200" in FIG. 7 is 20.0% humidity. For example, the humidity in FIG. 7 begins (at time zero seconds) at about 25.0% and ends, e.g., after the dry operation (which is a dry portion 708 of a one-step cycle in the exemplary embodiment illustrated in FIG. 7), at about 25.0%. The end of the dry operation in FIG. 7 may be at between about 16,000 seconds and about 18,000 seconds, e.g., between about 4.5 hours and about 5 hours of total cycle time, e.g., the total wash and dry time in the exemplary one-step cycle illustrated by FIG. 7 may be between about 4.5 hours and about 5 hours, which may be an example of a total time for which the one-step cycle or other drying cycle in a washing machine appliance may be acceptable or recommended. It should be understood that the foregoing values for humidity and time are exemplary only and provided purely for the sake of illustration.

Figure 8:
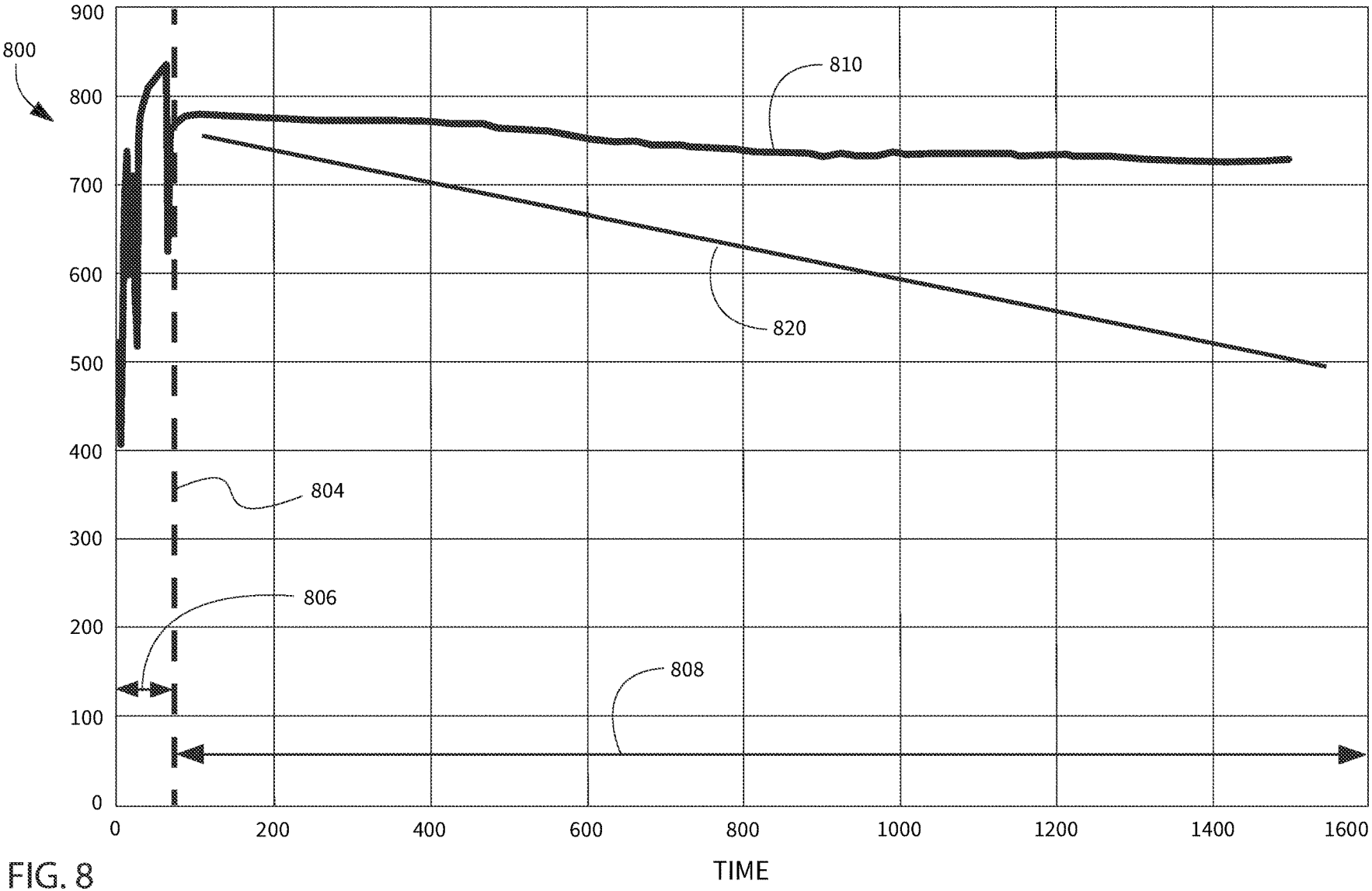
FIG. 8 provides another exemplary plot of humidity over time for an additional exemplary operation which includes washing and drying a load of articles in a washing machine appliance according to one or more additional exemplary embodiments of the present disclosure.

FIG. 8 provides a graph 800 of humidity over time in another exemplary one-step wash and dry operation in a washing machine appliance. The operation represented by graph 800 in FIG. 8 includes a wash portion 806 and a dry portion 808, which are separated by line 804 for illustrative purposes in FIG. 8. As may be seen in FIG. 8, the slope of line 810 during the dry portion 808 is low, e.g., generally flat. In particular, the slope of line 810 may be compared to a minimum slope 820 and, when the slope is less than the minimum slope 820, e.g., is flatter than minimum slope 820, the dry operation may not be effective, e.g., a time for the load of articles in the washing machine appliance to be dried, e.g., to reach a humidity of about 30.0% or less, such as about 25.0% humidity, may be excessive, such that the dry operation in the example illustrated in FIG. 8 is an example for which a drying cycle in the washing machine appliance, e.g., a one-step wash and dry cycle, may not be recommended. For example, the load of articles in the operation illustrated in FIG. 8 may be too large for a one-step wash and dry cycle.

In various embodiments, the washing machine appliance may include features for obtaining images, such as images of the washing machine appliance, portions thereof, contents of the washing machine appliance, e.g., articles therein, and/or areas around the washing machine appliance. Such features may include one or more cameras and/or camera assemblies which may be mounted on or in the washing machine appliance and/or which may be communicatively coupled with the washing machine appliance, e.g., in wireless communication with the washing machine appliance. For example, such cameras may include a camera of a remote user interface device, e.g., as illustrated in FIG. 9.

Figure 9:
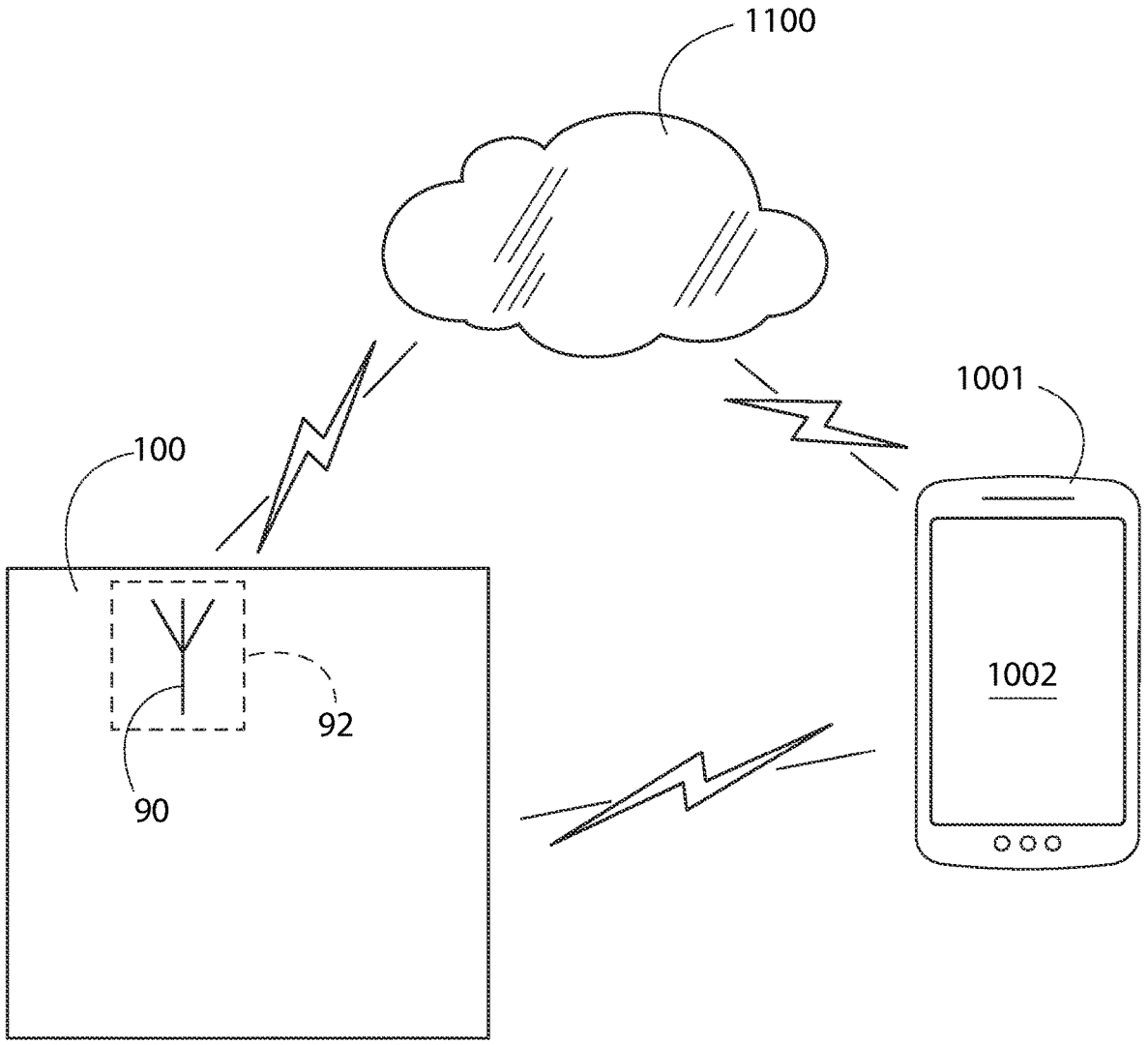
FIG. 9 provides a diagrammatic illustration of a washing machine appliance in communication with a remote computing device and with a remote user interface device according to one or more exemplary embodiments of the present subject matter.

A general schematic of a washing machine appliance 100, such as but not limited to washing machine appliance 100 described above, which communicates wirelessly with a remote user interface device 1001 and a network 1100 is provided in FIG. 9. For example, as illustrated in FIG. 9, the washing machine appliance 100 may include an antenna 90 by which the washing machine appliance 100 communicates with, e.g., sends and receives signals to and from, the remote user interface device 1001 and/or network 1100. The antenna 90 may be part of, e.g., onboard, a communications module 92. The communications module 92 may be a wireless communications module operable to connect wirelessly, e.g., over the air, to one or more other devices via any suitable wireless communication protocol. For example, the communications module 92 may be a WI-FI® module, a BLUETOOTH® module, or a combination module providing both WI-FI® and BLUETOOTH® connectivity. The remote user interface device 1001 may be a laptop computer, smartphone, tablet, personal computer, wearable device, smart speaker, smart home system, and/or various other suitable devices. The communications module 92 may be onboard the controller 186 or may be a separate module.

The washing machine appliance 100 may be in communication with the remote user interface device 1001 device through various possible communication connections and interfaces. The washing machine appliance 100 and the remote user interface device 1001 may be matched in wireless communication, e.g., connected to the same wireless network. The washing machine appliance 100 may communicate with the remote user interface device 1001 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the washing machine appliance 100 and the remote user interface device 1001. For example, BLUETOOTH® Low Energy may advantageously minimize the power consumed by the exemplary methods and devices described herein due to the low power networking protocol of BLUETOOTH® Low Energy.

The remote user interface device 1001 is "remote" at least in that it is spaced apart from and not structurally connected to the washing machine appliance 100, e.g., the remote user interface device 1001 is a separate, stand-alone device from the washing machine appliance 100 which communicates with the washing machine appliance 100 wirelessly. Any suitable device separate from the washing machine appliance 100 that is configured to provide and/or receive communications, information, data, or commands from a user may serve as the remote user interface device 1001, such as a smartphone (e.g., as illustrated in FIG. 9), smart watch, personal computer, smart home system, or other similar device. For example, the remote user interface device 1001 may be a smartphone operable to store and run applications, also known as "apps," and some or all of the method steps disclosed herein may be performed by a smartphone app.

The remote user interface device 1001 may include a memory for storing and retrieving programming instructions. Thus, the remote user interface device 1001 may provide a remote user interface which may be an additional user interface to the user interface panel 180. For example, the remote user interface device 1001 may be a smartphone operable to store and run applications, also known as "apps," and the additional user interface may be provided as a smartphone app.

As mentioned above, the washing machine appliance 100 may also be configured to communicate wirelessly with a network 1100. The network 1100 may be, e.g., a cloud-based data storage system including one or more remote computing devices such as remote databases and/or remote servers, which may be collectively referred to as "the cloud." The network 1100 may include, e.g., one or more remote computing devices, such as a remote database, remote server, etc., in a distributed computing environment. Such distributed computing environments may include, for example, cloud computing, fog computing, and/or edge computing. For example, the washing machine appliance 100 may communicate with the network 1100 over the Internet, which the washing machine appliance 100 may access via WI-FI®, such as from a WI-FI® access point in a user's home, or in a laundromat or dormitory, etc.

The remote user interface device 1001 may be configured to capture and/or display images. For example, the remote user interface device 1001 may be a smartphone, e.g., as illustrated in FIG. 9, which includes both a camera (not shown) for capturing images and a display 1002, e.g., a touchscreen or other screen, for displaying images.

Figure 10:
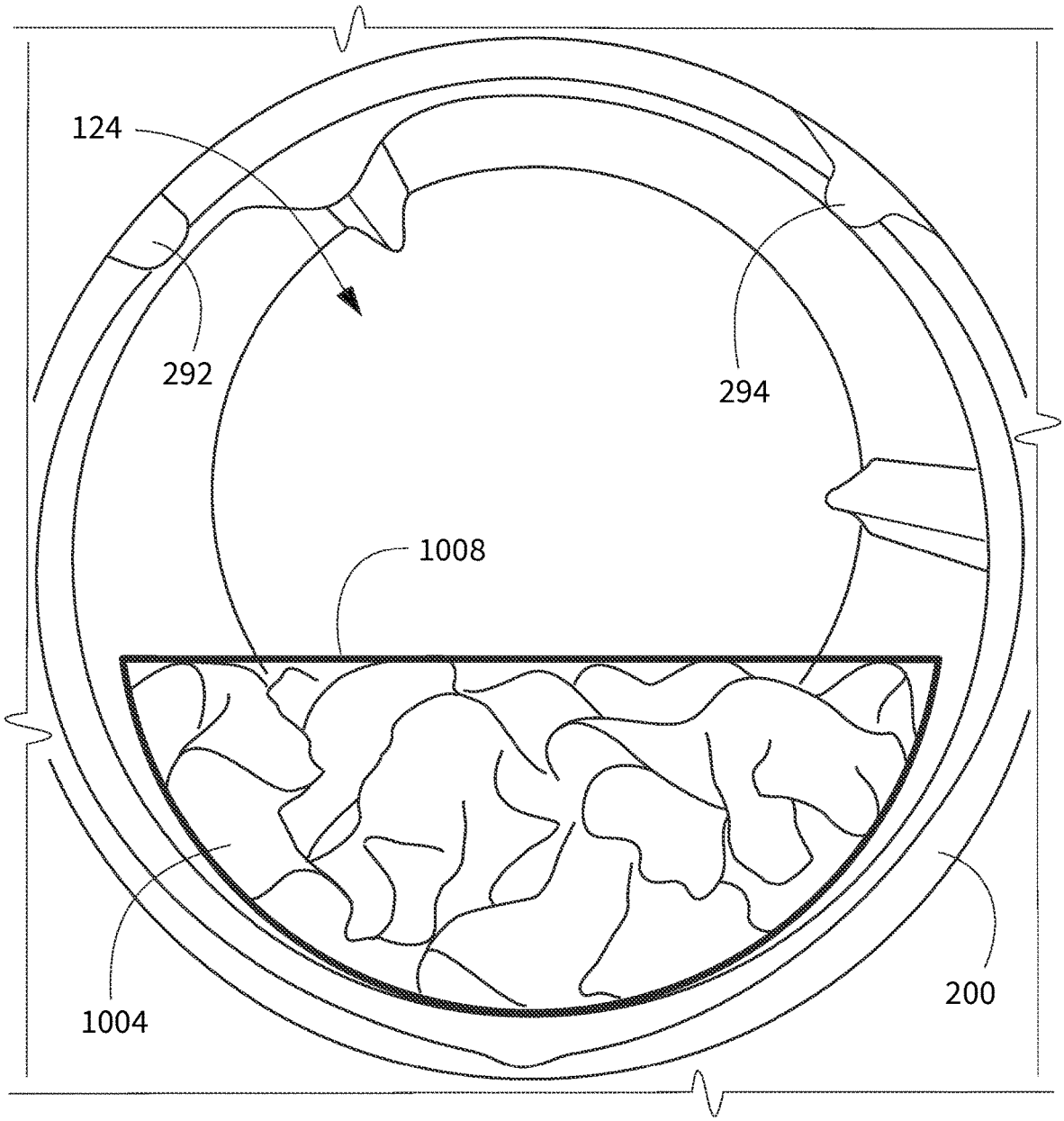
FIG. 10 illustrates an exemplary image which may be displayed on a display of a computing device such as remote user interface device, where the image includes an image of a washing machine appliance with an exemplary load of articles therein and an overlay, according to one or more exemplary embodiments of the present subject matter.
Figure 11:
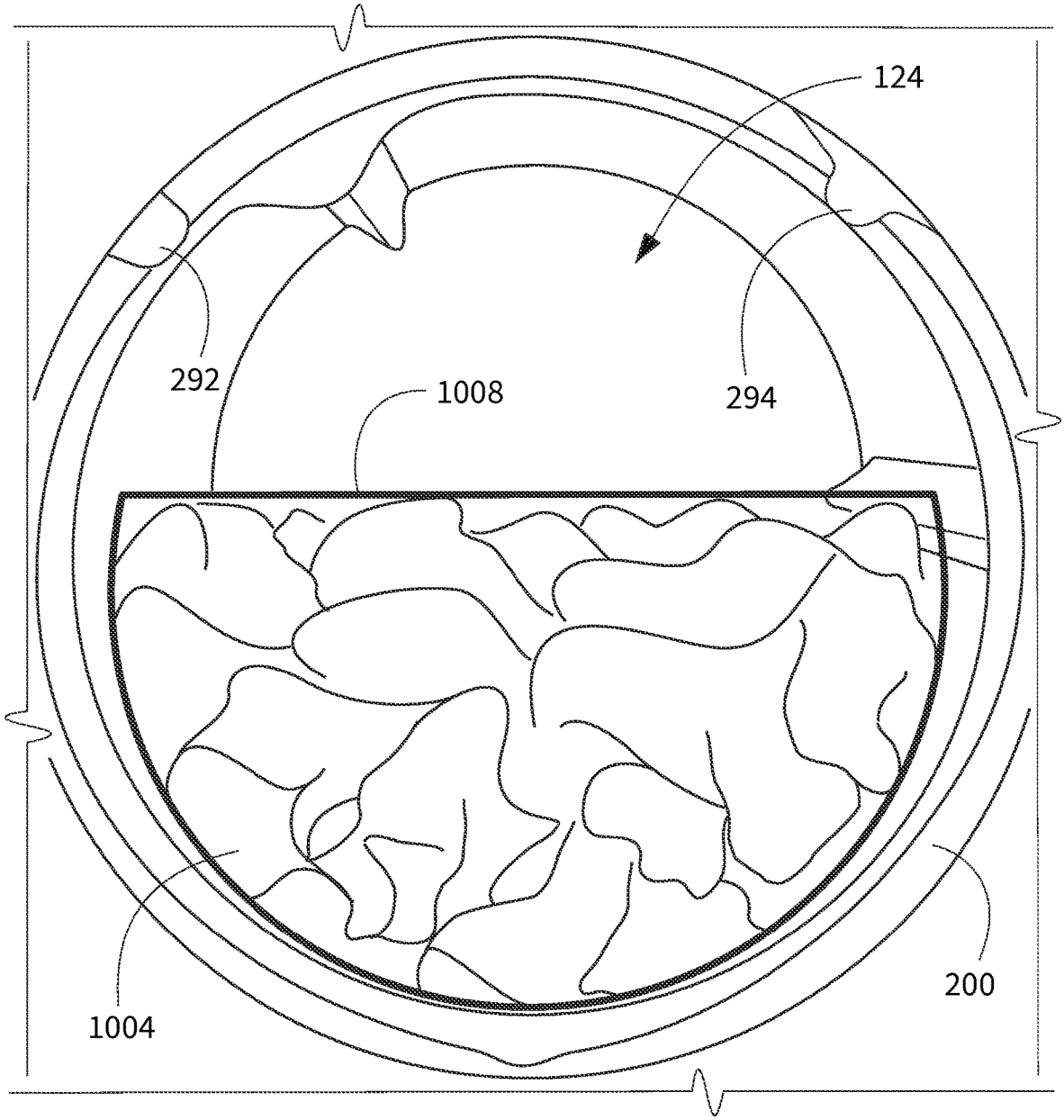
FIG. 11 illustrates an exemplary image which may be displayed on a display of a computing device such as remote user interface device, where the image includes an image of a washing machine appliance with another exemplary load of articles therein and an overlay, according to one or more exemplary embodiments of the present subject matter.
Figure 12:
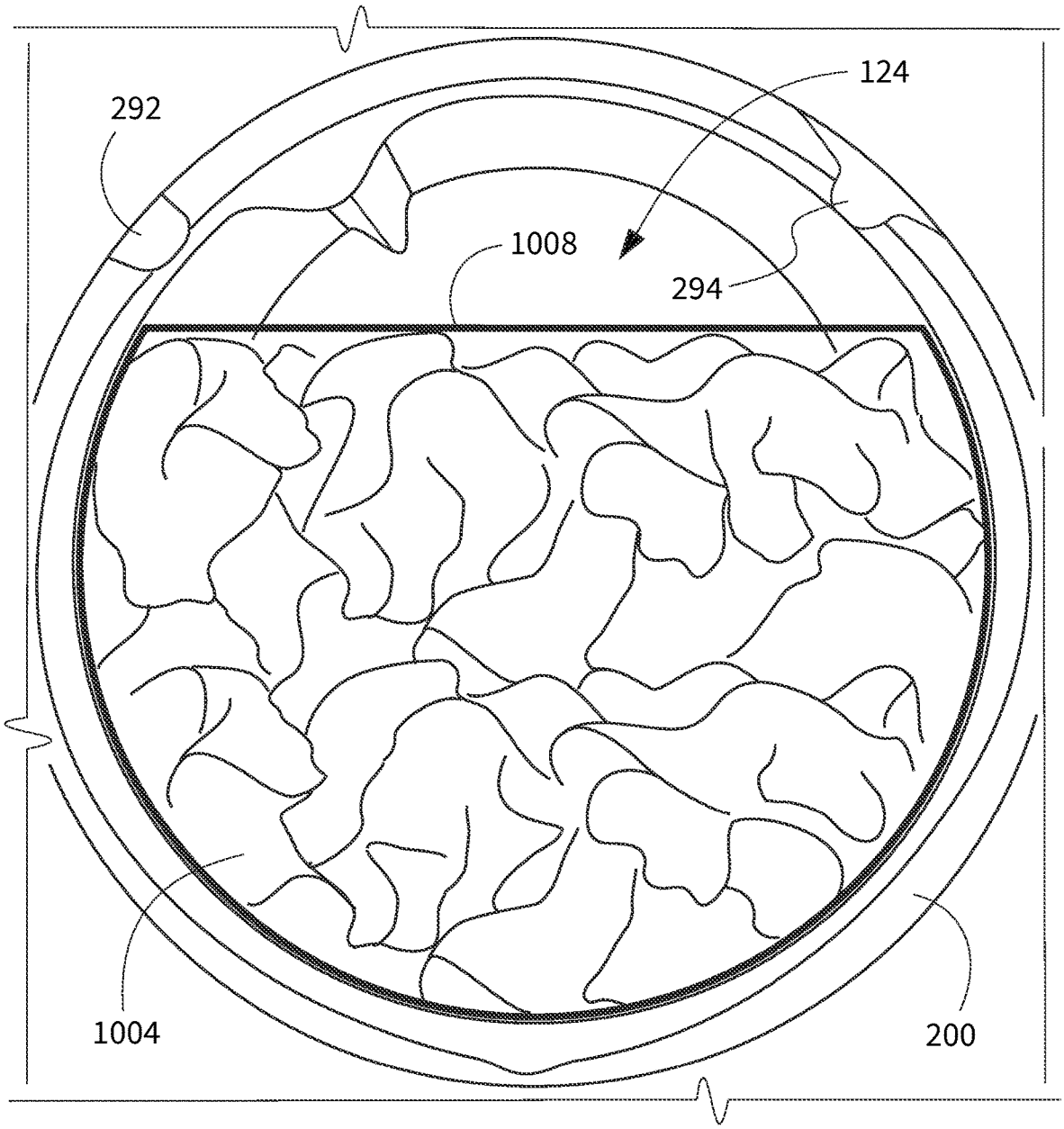
FIG. 12 illustrates an exemplary image which may be displayed on a display of a computing device such as remote user interface device, where the image includes an image of a washing machine appliance with yet another exemplary load of articles therein and an overlay, according to one or more exemplary embodiments of the present subject matter.

Various examples of loads of articles, images of which may be captured or obtained according to various embodiments of the present disclosure, are illustrated in FIGS. 10 through 12. As is generally seen throughout FIGS. 10 through 12, the images may generally include at least a portion of the wash chamber 124 within the frame of the image. As mentioned above, such images may be obtained using one or more cameras or camera assemblies, such as a camera of a remote user interface device or a camera embedded in the washing machine appliance, such as a camera mounted on the door of the washing machine appliance or at the gasket 200, e.g., such as the exemplary camera 292 mounted at the gasket 200 as illustrated in FIGS. 10 through 12.

The camera 292 is illustrated schematically in FIGS. 10 through 12 and, in some embodiments, the camera 292 may be generally positioned and configured for obtaining images of washing machine appliance 100. Specifically, according to the illustrated embodiment, camera 292 may be mounted to cabinet 102, e.g., at or near the gasket 200, or may be otherwise positioned in view of the wash chamber 124, e.g., camera 292 may be positioned and oriented to have a field of view directed across the front opening and/or into wash chamber 124.

Although a single camera 292 is illustrated in FIGS. 10 through 12, it should be appreciated that washing machine appliance 100 may include a plurality of cameras 292 positioned on and/or within cabinet 102, wherein each of the plurality of cameras 292 has a specified monitoring zone or range. It should be appreciated that according to alternative embodiments, washing machine appliance 100 may include any suitable number, type, size, and configuration of camera(s) 292 for obtaining images of any suitable areas or regions within or around washing machine appliance 100. In addition, it should be appreciated that each camera 292 may include features for adjusting the field of view and/or orientation.

It should be appreciated that the images obtained by camera 292 may vary in number, frequency, angle, resolution, detail, etc. in order to improve the clarity of the particular regions surrounding or within washing machine appliance 100. In addition, according to exemplary embodiments, controller 186 may be configured for illuminating the wash chamber 124 using one or more light sources prior to obtaining images. Notably, controller 186 of washing machine appliance 100 (or any other suitable dedicated controller) may be communicatively coupled to camera 292 and may be programmed or configured for analyzing the images obtained by camera 292, e.g., in order to identify or analyze items in washing machine appliance 100, e.g., a load of articles therein, as described in more detail below.

In general, controller 186 may be operably coupled to camera 292 for analyzing one or more images obtained by camera 292 to extract useful information regarding objects located within the washing machine appliance. In this regard, for example, images obtained by camera assembly 292 may be used to determine or estimate properties of one or more articles, or of a collective load of multiple articles, such as size, type, and/or characteristics of the article or load of articles. Notably, this analysis may be performed locally (e.g., on controller 186) or may be transmitted to a remote server (e.g., in the "edge," the "fog," and/or in the "cloud," as those of ordinary skill in the art will recognize as referring to a remote server or database in a distributed computing environment including at least one remote computing device in communication with the local controller 186, such as the exemplary network 1100 illustrated in FIG. 9 and described above) for analysis.

The images obtained by camera 292 may include one or more still images, one or more video clips, or any other suitable type and number of images suitable for identification of one or more articles or a load of articles.

It should be appreciated that the images obtained by camera 292 may vary in number, frequency, angle, resolution, detail, etc. in order to improve the clarity of the load of articles. In addition, according to exemplary embodiments, controller 186 may be configured for illuminating a light 294 while obtaining an image or images. Other suitable imaging triggers are possible and within the scope of the present subject matter.

The image or images obtained by or with the camera 292, a camera of a remote user interface device, or other suitable camera(s), such as the example images illustrated in FIGS. 10 through 12 may be analyzed to determine the size, proportion, and/or position of various components of the washing machine appliance, such as the wash basket, the wash chamber defined in the wash basket, and/or a load of articles positioned in the wash chamber, based at least in part on the one or more images, e.g., based on an image processing algorithm and a machine learning image recognition process. Each of these image evaluation processes will be described below according to exemplary embodiments of the present subject matter. It should be appreciated that image processing and machine learning image recognition processes may be used together to provide an extra safety factor and redundant detection methods to improve the accuracy of detecting the size, proportion, and/or position of the selected components of interest. In some exemplary embodiments, such redundant or duplicative detection methods may be desirable to improve the likelihood of accurate detection.

As used herein, the term "image processing algorithm" and the like is generally intended to refer to any suitable methods or algorithms for analyzing images of wash chamber 124 and/or a load of articles therein that do not rely on artificial intelligence or machine learning techniques (e.g., in contrast to the machine learning image recognition process as described below). For example, the image processing algorithm may rely on image differentiation, e.g., such as a pixel-by-pixel comparison of two sequential images. Image differentiation may be used to, for example, determine if a position, location, or geometric property, e.g., shape, area, or dimension, etc., of a component changes, such as crosses a threshold, e.g., a minimum or maximum, such as a minimum or maximum load size of a load of articles in the wash chamber 124.

Additional embodiments may also include using a machine learning image recognition process instead of or in addition to an image processing algorithm. In this regard, the images obtained by the camera may be analyzed by controller 186. In addition, it should be appreciated that this image analysis or processing may be performed locally (e.g., by controller 186) or remotely, such as by using distributed computing, a digital cloud, or a remote server, such as in a cloud computing system or other distributed computing environment, e.g., edge computing or fog computing. According to exemplary embodiments of the present subject matter, the images obtained with the camera may be analyzed using a neural network classification module and/or a machine learning image recognition process. In this regard, for example, controller 186 may be programmed to implement the machine learning image recognition process that includes a neural network trained with a plurality of images of the wash chamber 124 and/or controller 186 may communicate with a remote server (such as in the cloud, etc., as mentioned) where the remote server implements all or a portion of the machine learning image recognition process.

As used herein, the terms image recognition process and similar terms may be used generally to refer to any suitable method of observation, analysis, image decomposition, feature extraction, image classification, etc. of one or more images or videos taken of a wash chamber of a washing machine appliance, such as images or videos of areas, volumes, and/or regions within and/or around the wash chamber. In this regard, the image recognition process may use any suitable artificial intelligence (AI) technique, for example, any suitable machine learning technique, or for example, any suitable deep learning technique. It should be appreciated that any suitable image recognition software or process may be used to analyze images taken by the camera, and that controller 186 may be programmed to perform such processes and take corrective action or other responsive actions.

According to an exemplary embodiment, controller may implement a form of image recognition called region-based convolutional neural network ("R-CNN") image recognition. Generally speaking. R-CNN may include taking an input image and extracting region proposals that include a potential object, such as a particular garment, a region of a load of clothes, or the size or position of the agitation element. In this regard, a "region proposal" may be regions in an image that could belong to a particular object, such as a load of articles in the wash basket. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like.

According to still other embodiments, the image recognition process may use any other suitable neural network process. For example, the image recognition process may include using Mask R-CNN instead of a regular R-CNN architecture. In this regard, Mask R-CNN is based on Fast R-CNN which is slightly different than R-CNN. In addition, a K-means algorithm may be used. Other image recognition processes are possible and within the scope of the present subject matter.

It should be appreciated that any other suitable image recognition process may be used while remaining within the scope of the present subject matter. For example, the image or images from the camera (e.g., of the washing machine appliance or the camera of a remote user interface device, as noted above) may be analyzed using a deep belief network ("DBN") image recognition process. A DBN image recognition process may generally include stacking many individual unsupervised networks that use each network's hidden layer as the input for the next layer. According to still other embodiments, the image or images may be analyzed by the implementation of a deep neural network ("DNN") image recognition process, which generally includes the use of a neural network (computing systems inspired by biological neural networks) with multiple layers between input and output. Other suitable image recognition processes, neural network processes, artificial intelligence ("AI") analysis techniques, and combinations of the above described or other known methods may be used while remaining within the scope of the present subject matter.

An overlay may be developed from such image analysis or processing, whereby the overlay may correspond to positions or alignments of components of the washing machine appliance, contents within the wash chamber, or other objects in and/or around the washing machine appliance. For example, the image analysis or processing may include recognizing, determining, and/or estimating the volume of the wash chamber from the image. As another example, the image analysis or processing may also or instead include recognizing, determining, and/or estimating the size and/or position of a load of articles in the wash chamber. In additional exemplary embodiments, one or more other components or aspects of the washing machine appliance may be recognized or otherwise analyzed from the obtained image as well as or instead of the wash chamber volume and/or load of articles.

Turning now to FIGS. 10 through 12 collectively, FIGS. 10 through 12 illustrate exemplary images which may be provided on, e.g., displayed by, a display such as display 1002 of the remote user interface device 1001. The display 1002 may generate, reproduce, and/or otherwise display a static image or a dynamic (e.g., animated or updated) image, which may be or include an image of a washing machine appliance, such as the exemplary washing machine appliance 100 described above, obtained by a camera. The image obtained by the camera may be, for example, a live image, e.g., that is captured and displayed in real time. In other embodiments, the image may be a still image or a series of still images, such as a chronological series of images, e.g., taken one or more seconds apart at generally regular intervals. For example, the image, e.g., live image or series of still images, may reflect addition or removal or rearrangement of articles within the wash chamber 124.

The image provided on the display 1002 of the remote user interface 1001 may be a composite or synthesized image, e.g., the image may include additional elements as well as the image obtained by the camera, such as a graphical overlay, a text overlay, or a combined overlay including both graphical elements and text elements. For example, such elements may include text elements, where the text elements on the display 1002 may include explanatory text or instructions, e.g., pertaining to one or more operating parameters of the washing machine appliance, such as load size. Also by way of example, the overlay may user interface elements, e.g., interactive elements, such as a control or input, e.g., which a user may tap on or click on to activate or adjust operation of the washing machine appliance.

FIGS. 10 through 12 each represents an exemplary image, such as a live image, of the washing machine appliance which may be captured, e.g., by a camera of a remote user interface device, and which may be displayed, e.g., live or in real-time or near real-time, on a display such as the display 1002 of the remote user interface device 1001. Thus, it is to be understood that a "live image" as used herein is intended to include images which are continuously updated in real time or with some delay and which may be updated at least about once per second, e.g., which have a refresh rate of 1 Hz or greater. In particular, the exemplary images in FIGS. 10 through 12 each includes or depicts at least a portion of the washing machine appliance, such as the wash basket 124 (FIG. 2) and/or the opening 142 which permits access into the wash basket 124. In some embodiments, the image may also include or depict a load of articles 1004 in the wash basket 124.

In some embodiments, the one or more images may be analyzed, e.g., to determine a load size and/or compare the load size to one or more load size thresholds.

FIGS. 10 through 12 each represents an exemplary image including an overlay in addition to the image of the washing machine appliance, such as an image which may be displayed on the display 1002 of a remote user interface device. As illustrated in FIGS. 10 through 12, the overlay may include a mask 1008, e.g., which corresponds to or overlies (in the image on the display 1002) the load of articles 1004 in the wash basket. Such mask 1008 may be used in or generated by an image analysis process which includes determining or identifying, such as via one or more region proposals, a region (e.g., within the wash chamber 124) occupied by the load of articles 1004. For example, the region occupied by the load of articles 1004 may be used in determining a load size of the load of articles. The load size may be, for example, measured or estimated as a proportion, such as a percentage, of the volume of the wash chamber 124. The proportion may be, for example, a ratio or percentage of the region occupied by the load of articles compared to a region representing the entire wash chamber. Such load size may be displayed as a text element of the overlay.

For example, the load size may be expressed as a percentage, e.g., of the volume of the wash chamber 124. For example, the load size illustrated in FIG. 10 may be about thirty percent (30%), the load size illustrated in FIG. 11 may be about fifty percent (50%), and the load size illustrated in FIG. 12 may be about seventy-five percent (75%). In some exemplary embodiments, the load size may be, e.g., estimated or otherwise determined using image analysis or processing, e.g., mask R-CNN image analysis.

The load size may be used to determine a recommended drying cycle, such as recommending a drying cycle based on the determined load size, e.g., by looking up the determined load size in a lookup table to identify a corresponding recommendation in the lookup table. For example, a relatively small load size, such as 25% or less, such as about 15%, may have a recommended drying cycle in the washing machine appliance, such as a one-step wash and dry cycle, having a first dry time, while a larger load size, such as about 25% or more, such as between about 30% and about 50%, may have a recommended drying cycle in the washing machine appliance, such as a one-step wash and dry cycle, having a second dry time greater than the first dry time. Additionally, larger load sizes, e.g., about 50% or more, such as about 75% or more, etc., may have a recommended drying cycle in an appliance other than the washing machine appliance, such as in a dryer appliance. For example, the load of articles in FIG. 10 may have a recommended drying cycle, e.g., as determined by looking up the load size in a lookup table as described above, having the first dry time, whereas the load of articles in FIG. 11 may have a recommended drying cycle in the washing machine appliance having the second dry time greater than the first dry time, and the load of articles illustrated in FIG. 12 may have a recommended drying cycle in a dryer appliance.

Figure 13:
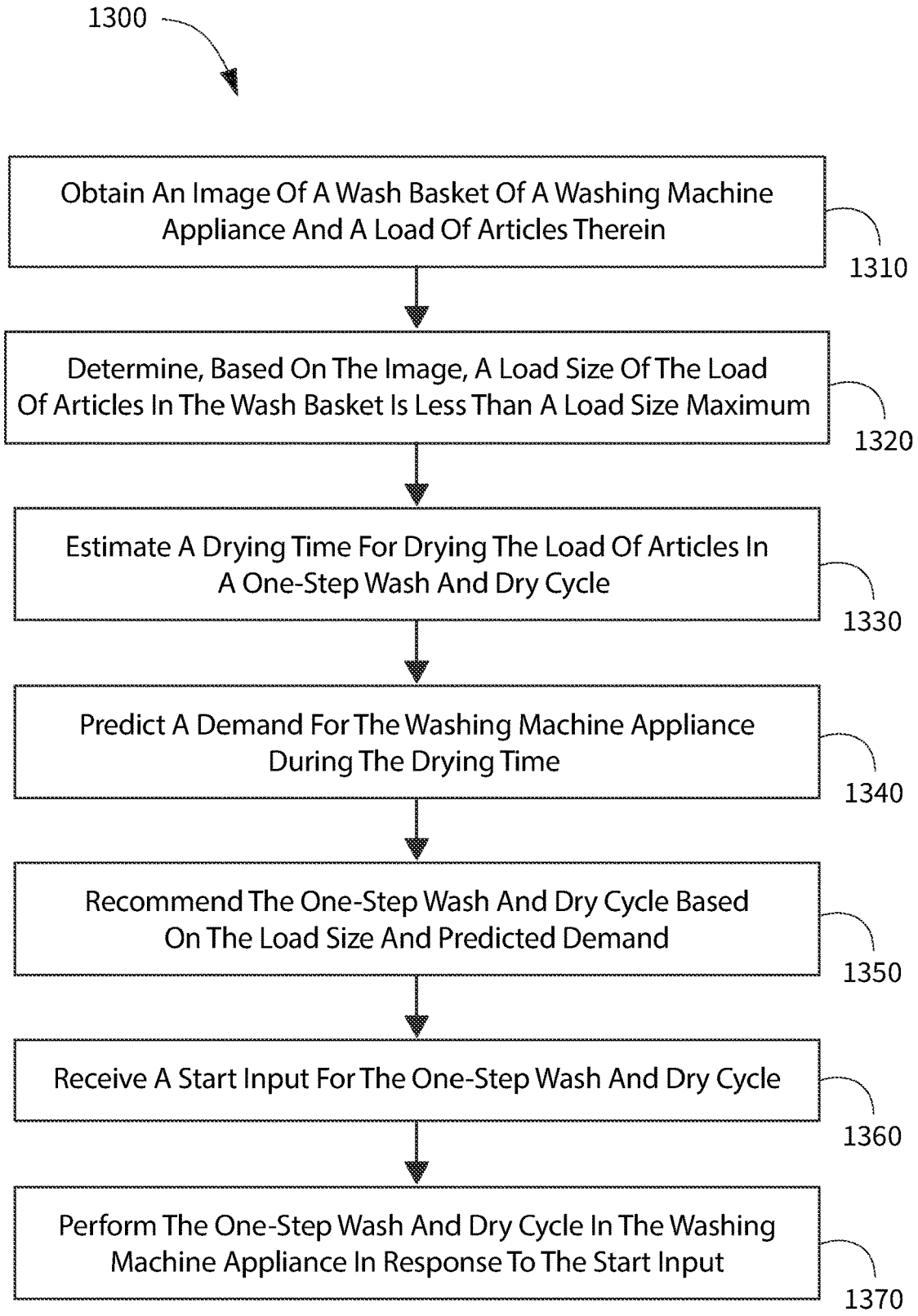
FIG. 13 provides a flow diagram of an exemplary method of operating a washing machine appliance according to one or more exemplary embodiments of the present disclosure.

FIG. 13 illustrates an exemplary method 1300 of treating a load of articles in a wash basket of a washing machine appliance, which may include drying the load of articles in the washing machine appliance, e.g., in a wash basket thereof, according to one or more exemplary embodiments of the present disclosure. Thus, moisture may be removed from the articles during such treatment. Such moisture may be exhausted, e.g., vented such as through a vent line and/or an aperture, to an ambient environment outside of the washing machine appliance. Method 1300 may be used instead of or in addition to drying the load of articles in a dryer appliance. For example, method 1300 may be or may be a part of a one-step cycle wherein articles are successively washed and dried in a single process in a single appliance, such as a single continuous sequence or process. The one-step wash and dry cycle may be performed, e.g., in a washing machine appliance which does not include a heating element, such as in a washing machine appliance that is not a dryer appliance or a combination washer-dryer appliance, such as in a laundry appliance that does not include features specific to operations for drying articles in the appliance. For example, the vent aperture and related features are not specific to drying operations because such features may also be used for ventilating the washing machine appliance when the washing machine appliance is empty, e.g., after a cycle or between cycles, such that the washing machine appliance may include the vent aperture, etc., without being considered a dryer appliance or combination washer-dryer appliance.

Exemplary methods such as method 1300 may also be used in conjunction with a dryer appliance, e.g., to partially pre-dry the articles before completing the drying in the dryer appliance, such as to reduce the overall energy consumption for drying the articles, or to recommend drying the load of articles in the dryer appliance, e.g., when the load size of the load of articles indicates the dry time in the washing machine alone may be longer than desired. Method 1300 can be implemented using any suitable washing machine appliance, including for example, horizontal axis washing machine appliance 100 of FIGS. 1 and 2. Accordingly, to provide context to method 900, reference numerals utilized to describe the features of washing machine appliance 100 in FIGS. 1 through 6 will be used below.

The method 1300 may include obtaining an image of a wash basket of the washing machine appliance and a load of articles therein, e.g., as indicated at 1310 in FIG. 13. The image may include the load of articles and surrounding portions of the wash chamber, e.g., such that the percentage or proportion of the wash chamber that is occupied by the load of articles may be discerned in the image, such as by image analysis or processing. Thus, exemplary embodiments of method 1300 may include determining (1320), based on the image, a load size of the load of articles in the wash basket. For example, the determined load size may be a percentage, such as a percentage of the wash basket internal volume that is occupied by the load of articles, e.g., which may be determined based on the size of a region in the image occupied by the load of articles. The method 1300 may also include comparing the determined load size, e.g., percentage, to a load size maximum, and the determining (1320) may thus include determining, based on the image, a load size of the load of articles in the wash basket is less than the load size maximum. The load size maximum may be a maximum load size for effective drying in the washing machine appliance during a one-step wash and dry cycle, e.g., where "effective" drying includes cycles such as the exemplary cycle illustrated in FIG. 7 and discussed above.

As noted above, the method 1300 may be performed in whole or in part by a controller of the washing machine appliance. For example, in various embodiments, determining (1320) a load size of the load of articles in the wash basket is less than the load size maximum based on the image may be performed by the controller, such as the controller may analyze the image to determine the load size, or the image analysis may be performed remotely, e.g., in the cloud, wherein determining the load size of the load of articles in the wash basket is less than a load size maximum based on the image by the controller may be or may include receiving load size information based on the image from a remote computing device, such as a computing device in the cloud, the edge, or other distributed computing environment.

Method 1300 may further include estimating a drying time for drying the load of articles in a one-step wash and dry cycle, e.g., as illustrated at 1330 in FIG. 13. The estimated drying time may also be based on the load size as determined from the image. The estimated drying time may further be based on a load type of the load of articles as well as or instead of the load size.

The estimated drying time may be useful not only for predicting the performance of the one-step wash and dry cycle in the washing machine appliance, but may also be useful for gauging the potential impact of performing the one-step wash and dry cycle in the washing machine appliance on a larger group of laundry appliances of which the washing machine appliance is a member, such as in a laundromat or other commercial setting, e.g., dormitory or apartment building. For example, when the laundromat is busy, such as during peak hours, performing the one-step wash and dry cycle in the washing machine appliance may not be desired because the demand for the washing machine appliance may be high, such that other potential users of the washing machine appliance may be delayed or deterred from using the washing machine appliance due to the time taken to complete the one-step wash and dry cycle. Thus, exemplary methods according to embodiments of the present subject matter may include predicting a demand for the washing machine appliance during the drying time, e.g., as indicated at 1340 in FIG. 13.

When the load size is less than the maximum load size, e.g., such that the one-step wash and dry cycle may be effectively performed in the washing machine appliance, and when the predicted demand for the washing machine appliance during the drying time is less than a maximum demand, e.g., during off-peak hours, method 1300 may include recommending the one-step wash and dry cycle, e.g., as indicated at 1350 in FIG. 13, such as method 1300 may include determining the one-step wash and dry cycle is recommended based on the determined load size less than the load size maximum and the predicted demand for the washing machine appliance during the drying time less than a maximum demand. As mentioned above, recommending the one-step wash and dry cycle when demand is low, e.g., during off-peak hours, may increase the convenience of other users in the laundromat (or other commercial group of laundry appliances). Recommending the one-step wash and dry cycle during such hours may also increase the convenience of the current user as well, such as by freeing the user from having to wait for a wash cycle to complete and then transfer the articles to one or more dryer appliances. For example, if the one-step wash and dry cycle is initiated during the evening or night, the user may return home while the one-step wash and dry cycle is carried out in the washing machine appliance and return the following morning (or, as another example, the user could return later the same day, such as when the one-step wash and dry cycle is started early on a weekday morning and the one-step wash and dry cycle is carried out while the user is at work).

In some embodiments, the one-step wash and dry cycle recommendation may be provided via a user notification. The user notification may include the recommended one-step wash and dry cycle based on the determined load size, such as a recommendation of the one-step wash and dry cycle based on the load size less than the maximum and the demand for the washing machine appliance less than the maximum demand. The user notification may be provided on a local user interface of the washing machine appliance, such as on a display, e.g., display 184, of the washing machine appliance, or may be provided on a remote user interface device such as a smartphone, tablet computer, smart home system, or other similar user interface device separate from the washing machine appliance (e.g., such as the remote user interface device 1001 illustrated in FIG. 9 and described above), or may be provided in various combinations of local and/or remote user interfaces.

In some embodiments, method 1300 may further include receiving a start input for the one-step wash and dry cycle, e.g., as indicated at 1360 in FIG. 13. For example, the start input may be received locally, e.g., from an input device onboard the washing machine appliance, such as on control panel 180, or remotely, e.g., wirelessly or over the air, such as from a remote user interface device. For example, the start input may be an acceptance or affirmative response to the recommendation to use the one-step wash and dry cycle, where the recommendation may be provided as described above.

Method 1300 may also include performing the one-step wash and dry cycle in the washing machine appliance in response to the start input, e.g., as indicated at 1370 in FIG. 13. For example, the one-step wash and dry cycle may include successively washing and drying the load of articles in the wash basket of the washing machine appliance, and drying the load of articles in the washing machine appliance may include rotating the wash basket within the washing machine appliance, e.g., for the estimated drying time which may, for example, be an estimated drying time based on the determined load size, such as a shorter first dry time for loads having a smaller first size or a longer second dry time for loads having a larger second size, e.g., as discussed above. As described above, such rotation of the wash basket may promote air flow into, through, and/or within the wash tub and wash basket, thereby enhancing or accelerating the drying of the load of articles. In such embodiments, the rotation of the wash basket may promote air flow and other fluid communication between the ambient environment and the wash basket, such as through the vent aperture(s) and/or vent line. Additionally, such rotation may be at a tumble speed, e.g., less than plaster speed, whereby the articles in the wash basket move around within the basket during the rotation, which may advantageously promote increased contact between the articles and air flowing into and/or through the wash basket to promote drying of the articles. For example, in at least some embodiments, the washing machine appliance may include a cabinet with the wash basket positioned within the cabinet, and the cabinet may include one or more vent apertures and/or a vent line through which air from outside of the wash tub, e.g., outside of the cabinet, may be drawn into the wash tub to contact the tumbling articles while the wash basket is rotated at the tumble speed.

If the load of articles is too large, however, the effect of tumbling may be mitigated or impaired in that the articles may be too crowded together inside the wash basket, such that the air flow does not effectively reach individual articles in order to promote drying of the articles as described hereinabove. Moreover, at least some loads of articles which may be a suitable size for a wash cycle or washing operation in the washing machine appliance may yet be too large for the drying operation. Accordingly, the dry operation may be less effective for loads over a certain size limit, and thus the one-step wash and dry cycle may be recommended based on the load size below the maximum load size, as discussed above.

Figure 14:
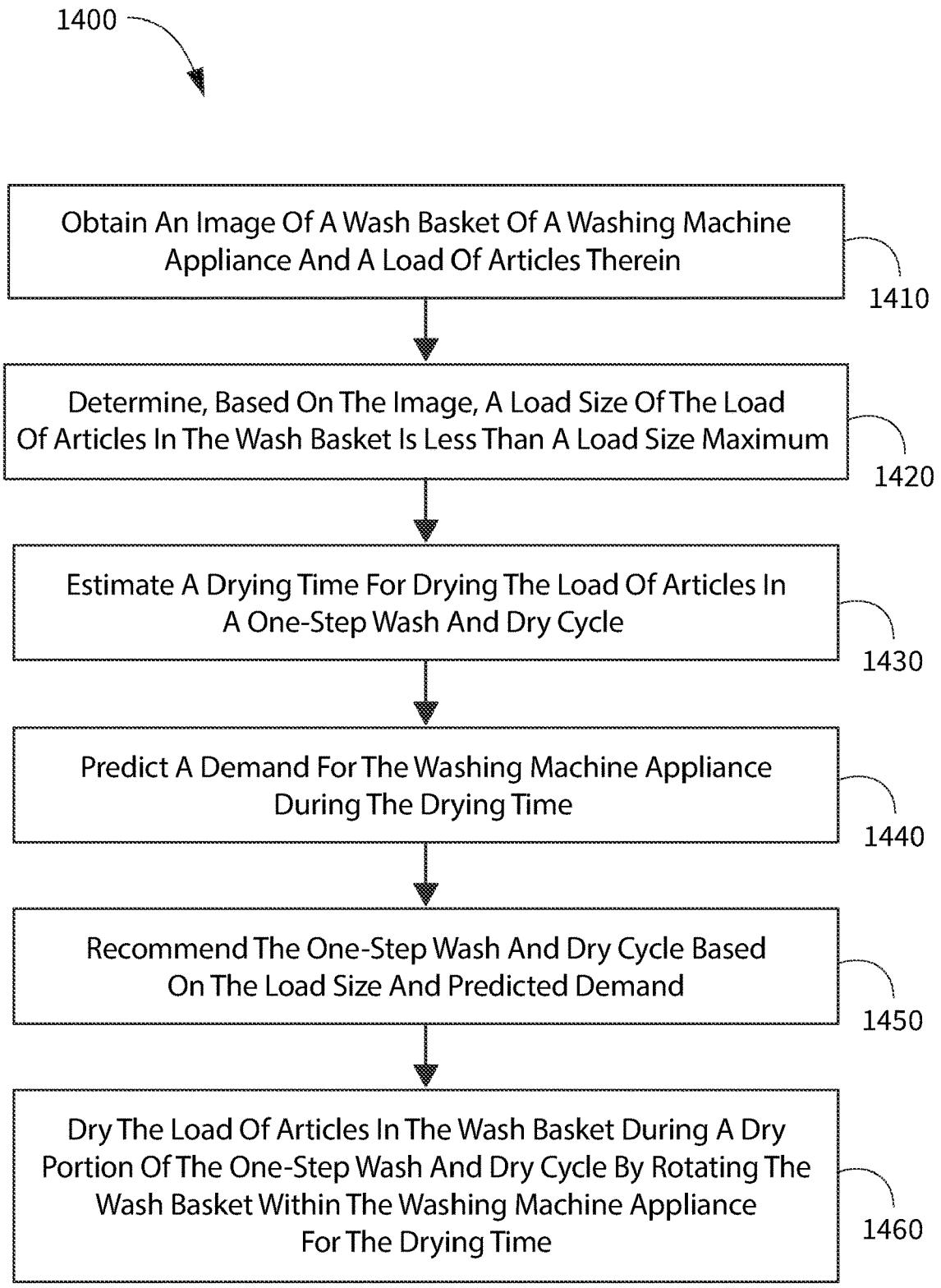
FIG. 14 provides a flow diagram of another exemplary method of operating a washing machine appliance according to one or more additional exemplary embodiments of the present disclosure.

Another exemplary method 1400 of treating a load of articles in a wash basket of a washing machine appliance is illustrated in FIG. 14. As illustrated at 1410 in FIG. 14, method 1400 may include obtaining an image of the wash basket of the washing machine appliance and a load of articles therein. For example, the image may be obtained by or from a remote user interface device, such as a smartphone including a camera, as discussed above. Obtaining the image (1410) in method 1400 may be similar to obtaining the image (1310) described above with respect to method 1300.

Method 1400 may also include determining, based on the image, a load size of the load of articles in the wash basket is less than a load size maximum, e.g., as indicated at 1420 in FIG. 14. Determining the load size (1420) in method 1400 may be similar to determining the load size (1320) described above with respect to method 1300.

Method 1400 may further include estimating a drying time for drying the load of articles in a one-step wash and dry cycle, e.g., as indicated at 1430 in FIG. 14, which may be similar to estimating (1330) described above with respect to method 1300. For example, estimating the drying time may include looking up the determined load size, e.g., from 1320 or 1420, in a lookup table, and identifying a drying time, e.g., one of the first dry time or second dry time discussed above, in the lookup table that is associated with the determined load size in the lookup table.

Method 1400 may also include predicting a demand for the washing machine appliance during the drying time, e.g., as indicated at 1440 in FIG. 14, and determining the one-step wash and dry cycle is recommended based on the determined load size less than the load size maximum and the predicted demand for the washing machine appliance during the drying time less than a maximum demand, e.g., as indicated at 1450 in FIG. 14. Predicting the demand (1440) may be similar to predicting the demand (1340) as described above with respect to method 1300 and FIG. 13, while recommending the one-step wash and dry cycle (1450) may be similar to recommending the one-step wash and dry cycle (1350) as described above with respect to method 1300 and FIG. 13.

Method 1400 may also include drying the load of articles in the wash basket during a dry portion of the one-step wash and dry cycle. For example, the load of articles may be dried during the dry portion by rotating the wash basket within the washing machine appliance for the drying time, e.g., as indicated at 1460 in FIG. 14.

Referring now generally to FIGS. 13 and 14, the methods 1300 and/or 1400 may be interrelated and/or may have one or more steps from one of the methods 1300 and 1400 combined with the other method 1300 or 1400. Thus, those of ordinary skill in the art will recognize that the various steps of the exemplary methods described herein may be combined in various ways to arrive at additional embodiments within the scope of the present disclosure.

FIGS. 13 and 14 depict steps in a particular order for purpose of illustration and discussion. Those of ordinary skill in the art, using the disclosures provided herein, will understand that (except as otherwise indicated) methods 1300 and 1400 are not mutually exclusive. Moreover, the steps of the methods 1300 and 1400 can be modified, adapted, rearranged, omitted, interchanged, or expanded in various ways without deviating from the scope of the present disclosure.

Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described herein may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

In some embodiments, the washing machine appliance may include a cabinet with an aperture defined through the cabinet. A wash tub may be positioned within the cabinet, and the washing machine appliance may further include a door pivotably mounted to the cabinet at an opening in the cabinet. It is to be understood that the aperture and the opening are distinct elements, e.g., two separate components, of the washing machine appliance in such embodiments. The door may be mounted to the cabinet such that the door is pivotable between an open position and a closed position. In such embodiments, the wash basket may be rotatably mounted within the wash tub, and the door may permit access to the wash basket through the opening when in the open position and the door may enclose or generally enclose the wash basket within the cabinet when in the closed position. The wash basket may be generally enclosed, for example, when fully enclosed and isolated from the ambient environment except for via the aperture and/or vent line. The aperture may be open to an ambient environment external to the cabinet when the door is in the closed position, e.g., whereby the washing machine appliance may provide ventilation and/or drying features while the door is closed, including one-step wash and dry cycles and other dry cycles during which the door may remain closed throughout. Thus, in at least some embodiments, rotating the wash basket may include drawing a flow of ambient air through the aperture from the ambient environment into the wash basket, e.g., the flow of ambient air may be drawn by the rotation of the wash basket. Additionally, the flow of ambient air may also or instead be drawn by a fan, e.g., fan 198 described above.

For example, some embodiments may include, prior to rotating the wash basket, opening a damper positioned within the cabinet of the washing machine appliance between the door and the wash basket to provide fluid communication between the wash basket and the ambient environment external to the cabinet. In such embodiments, the damper may be downstream of the aperture and upstream of the wash basket with respect to the flow of ambient air from the ambient environment external to the cabinet into and/or through the washing machine appliance.

As mentioned, embodiments of the present disclosure may include a one-step wash and dry operation, e.g., in a single continuous cycle in a single appliance. For example, methods of treating a load of articles in a washing machine appliance according to the present disclosure may include washing the load of articles in the wash basket prior to the drying operation, such as prior to rotating the wash basket within the washing machine appliance for the determined drying time. Washing the load of articles in the wash basket may include flowing a volume of water into a wash tub of the washing machine appliance and rotating the wash basket at an extraction speed after flowing the volume of water into the tub. The extraction speed may be a rotational speed at which the load of articles are generally fixed in place within the wash basket, such as plastered in the wash basket and against a wall, e.g., side wall, thereof, and at which moisture may be centrifugally extracted from the articles. Rotating the wash basket at the extraction speed may include wringing moisture from the load of articles due to such rotation. Such embodiments may further include activating a drain pump of the washing machine appliance whereby wash liquid is removed from the wash tub of the washing machine appliance after flowing the volume of water into the tub, e.g., the wash tub and/or the sump defined therein may be at least partially drained at an end of washing the load of articles, such as at an end of a wash portion of a one-step wash and dry cycle and just before the beginning of a dry portion of the one-step wash and dry cycle.

In some embodiments, the washing machine appliance may be a member of a group of laundry appliances, such as commercial laundry appliances, e.g., in a laundromat. In such embodiments, predicting the demand for the washing machine appliance may include estimating a portion of the group of laundry appliances that will be used during the drying time, e.g., that will be in use for at least a portion of the drying time. For example, the predicted demand for the washing machine appliance during the drying time less than a maximum demand may include a probability that the number of washing machines in the laundromat will reach the maximum demand at any point during the estimated drying time, e.g., from a present time until a future time that is chronologically separated from the present time by the estimated drying time.

In some embodiments, the predicted demand for the washing machine appliance during the drying time less than the maximum demand may include a probability of the maximum demand being reached during the drying time of about sixty percent or less, such as about fifty five percent or less, such as about fifty percent or less, such as about forty five percent or less, such as about forty percent or less, such as about thirty three percent or less, such as about twenty five percent or less, such as about twenty percent probability of the maximum demand being reached during the drying time.

The maximum demand may be a maximum number or percentage of washing machine appliances in the group of laundry appliances concurrently in use. For example, the maximum demand may be about fifty percent or more of the washing machine appliances concurrently in use at any point (or for at least a minimum length of time, such as the maximum washing machine appliances in the laundromat in use concurrently for at least about fifteen minutes or any other suitable minimum time) during the drying time, such as about sixty percent or more, such as about seventy percent or more, such as about seventy five percent or more of the washing machine appliances concurrently in use. In additional embodiments, any suitable maximum demand may be used, such as any suitable percentage which corresponds to at least one washing machine appliance available, e.g., ninety nine percent when the group of laundry appliances includes one hundred laundry appliances, etc.

The demand for the washing machine appliance during the drying time may be predicted by a machine learning model or other artificial intelligence program. For example, the prediction may be made by a neural network, which is understood in the context as used herein to refer to one or more computing systems inspired by the biological neural networks with multiple layers between input and output. In some embodiments, the prediction may be made using a Recurrent Neural Network ("RNN"), e.g., a neural network which uses time series data and which uses information from previous inputs to influence the current input and output. In some embodiments, the demand for the washing machine appliance during the drying time may be predicted based on one or more of current or predicted weather conditions, a date, such the day of the year (such as whether the current day is a holiday) and/or the day of the week, or a time of day. For example, the demand may be predicted based on whether the one-step wash and dry cycle is to be started on a weekday or weekend, a sunny day or a rainy day, and/or at which time of day the one-step wash and dry cycle is to be started. For example, using the artificial intelligence, such as the RNN model, the demand may be predicted based on previous usage levels of the washing machine appliances in the group of laundry appliances on past days having similar weather conditions, on the same day of the week, on the same day of the year, and/or same time of day as the present time, day, and/or weather conditions.

The several embodiments of the present disclosure provide numerous advantages. For example, but without limitation, the exemplary methods of treating a load of articles in a washing machine appliance may promote a more efficient and effective operation of the washing machine appliance, such as by ensuring a proper load size, e.g., the maximum amount of articles that can be effectively treated, e.g., dried, in each load. For example, recommending the one-step wash and dry cycle based on a determined load size (e.g., a load size determined using image analysis or otherwise based on an image of the wash basket), and demand for the washing machine appliance, may provide such advantages as described.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of treating a load of articles in a wash basket of a washing machine appliance, the method comprising:

obtaining an image of the wash basket of the washing machine appliance and the load of articles therein;

determining, based on the image, a load size of the load of articles in the wash basket is less than a load size maximum;

estimating a drying time for drying the load of articles in a one-step wash and dry cycle;

predicting a demand for the washing machine appliance during the drying time;

determining the one-step wash and dry cycle is recommended based on the determined load size less than the load size maximum and the predicted demand for the washing machine appliance during the drying time less than a maximum demand;

receiving a start input for the one-step wash and dry cycle; and performing the one-step wash and dry cycle in the washing machine appliance in response to the start input, wherein the one-step wash and dry cycle comprises successively washing and drying the load of articles in the wash basket of the washing machine appliance, wherein drying the load of articles in the washing machine appliance comprises rotating the wash basket within the washing machine appliance for the drying time.

2. The method of claim 1, wherein the washing machine appliance comprises a cabinet, an aperture defined through the cabinet, a wash tub positioned within the cabinet, and a door pivotably mounted to the cabinet at an opening in the cabinet, whereby the door is pivotable between an open position and a closed position, wherein the wash basket is rotatably mounted within the wash tub, wherein the door permits access to the wash basket through the opening when in the open position and encloses the wash basket within the cabinet when in the closed position, wherein the aperture is open to an ambient environment external to the cabinet when the door is in the closed position, and wherein rotating the wash basket within the washing machine appliance for the drying time comprises drawing a flow of ambient air through the aperture from the ambient environment into the wash basket.

3. The method of claim 1, wherein washing the load of articles in the wash basket comprises flowing a volume of water into a wash tub of the washing machine appliance, rotating the wash basket at an extraction speed after flowing the volume of water into the tub, and activating a drain pump of the washing machine appliance whereby wash liquid is removed from the wash tub of the washing machine appliance after flowing the volume of water into the tub.

4. The method of claim 1, further comprising, prior to rotating the wash basket within the washing machine appliance for the drying time, opening a damper positioned within a cabinet of the washing machine appliance between a door of the washing machine appliance and the wash basket to provide fluid communication between the wash basket and the ambient environment external to the cabinet, wherein the damper is downstream of the aperture and upstream of the wash basket with respect to the flow of ambient air from the ambient environment external to the cabinet through the washing machine appliance.

5. The method of claim 1, wherein the washing machine appliance is a member of a group of laundry appliances, wherein predicting the demand for the washing machine appliance comprises estimating a portion of the group of laundry appliances that will be used during the drying time.

6. The method of claim 5, wherein the predicted demand for the washing machine appliance during the drying time less than the maximum demand comprises less than fifty percent probability of the maximum demand being reached during the drying time.

7. The method of claim 1, wherein predicting the demand for the washing machine appliance during the drying time is based on one or more of current or predicted weather conditions, a date, or a time of day.

8. The method of claim 1, wherein determining the load size comprises determining a proportion of the wash basket that is occupied by the load of articles based on the image.

9. The method of claim 1, further comprising providing a user notification, the user notification comprising a recommendation of the one-step wash and dry cycle, wherein the start input is received in response to the user notification.

10. A method of treating a load of articles in a wash basket of a washing machine appliance, the method comprising:

obtaining an image of the wash basket of the washing machine appliance and a load of articles therein;

determining, based on the image, a load size of the load of articles in the wash basket is less than a load size maximum;

estimating a drying time for drying the load of articles in a one-step wash and dry cycle;

predicting a demand for the washing machine appliance during the drying time;

determining the one-step wash and dry cycle is recommended based on the determined load size less than the load size maximum and the predicted demand for the washing machine appliance during the drying time less than a maximum demand; and drying the load of articles in the wash basket during a dry portion of the one-step wash and dry cycle by rotating the wash basket within the washing machine appliance for the drying time.

11. The method of claim 10, wherein the washing machine appliance comprises a cabinet, an aperture defined through the cabinet, a wash tub positioned within the cabinet, and a door pivotably mounted to the cabinet at an opening in the cabinet, whereby the door is pivotable between an open position and a closed position, wherein the wash basket is rotatably mounted within the wash tub, wherein the door permits access to the wash basket through the opening when in the open position and encloses the wash basket within the cabinet when in the closed position, wherein the aperture is open to an ambient environment external to the cabinet when the door is in the closed position, and wherein rotating the wash basket within the washing machine appliance for the drying time comprises drawing a flow of ambient air through the aperture from the ambient environment into the wash basket.

12. The method of claim 10, further comprising washing the load of articles in the wash basket prior to rotating the wash basket within the washing machine appliance for the recommended drying time, wherein washing the load of articles in the wash basket comprises flowing a volume of water into a wash tub of the washing machine appliance, rotating the wash basket at an extraction speed after flowing the volume of water into the tub, and activating a drain pump of the washing machine appliance whereby wash liquid is removed from the wash tub of the washing machine appliance after flowing the volume of water into the tub.

13. The method of claim 10, further comprising, prior to rotating the wash basket within the washing machine appliance for the drying time, opening a damper positioned within a cabinet of the washing machine appliance between a door of the washing machine appliance and the wash basket to provide fluid communication between the wash basket and the ambient environment external to the cabinet, wherein the damper is downstream of the aperture and upstream of the wash basket with respect to the flow of ambient air from the ambient environment external to the cabinet through the washing machine appliance.

14. The method of claim 10, wherein the washing machine appliance is a member of a group of laundry appliances, wherein predicting the demand for the washing machine appliance comprises estimating a portion of the group of laundry appliances that will be used during the drying time.

15. The method of claim 14, wherein the predicted demand for the washing machine appliance during the drying time less than the maximum demand comprises less than half of the group of laundry appliances estimated to be used during the drying time.

16. The method of claim 10, wherein predicting the demand for the washing machine appliance during the drying time is based on one or more of current or predicted weather conditions, a date, or a time of day.

17. The method of claim 10, wherein determining the load size comprises determining a proportion of the wash basket that is occupied by the load of articles based on the image.

18. The method of claim 10, further comprising providing a user notification, the user notification comprising a recommendation of the one-step wash and dry cycle and receiving a start input for the one-step wash and dry cycle in response to the user notification before drying the load of articles in the wash basket.

* * * * *